US009911380B2

(12) United States Patent
Park et al.

(10) Patent No.: US 9,911,380 B2
(45) Date of Patent: Mar. 6, 2018

(54) ORGANIC LIGHT EMITTING DISPLAY DEVICE

(71) Applicant: SAMSUNG DISPLAY CO., LTD., Yongin, Gyeonggi-Do (KR)

(72) Inventors: Kyong-Tae Park, Yongin (KR); Tae-Gon Kim, Yongin (KR); Dong-Yoon So, Yongin (KR); Sung-Ho Cho, Yongin (KR)

(73) Assignee: SAMSUNG DISPLAY CO., LTD., Yongin, Gyeonggi-do (KR)

( * ) Notice: Subject to any disclaimer, the term of this patent is extended or adjusted under 35 U.S.C. 154(b) by 164 days.

(21) Appl. No.: 14/734,392

(22) Filed: Jun. 9, 2015

(65) Prior Publication Data

US 2016/0078811 A1 Mar. 17, 2016

(30) Foreign Application Priority Data

Sep. 16, 2014 (KR) ..... 10-2014-0122730

(51) Int. Cl.
*G09G 3/32* (2016.01)
*G09G 3/3233* (2016.01)

(52) U.S. Cl.
CPC ... *G09G 3/3233* (2013.01); *G09G 2300/0819* (2013.01); *G09G 2300/0852* (2013.01); *G09G 2300/0861* (2013.01); *G09G 2330/08* (2013.01); *G09G 2330/10* (2013.01)

(58) Field of Classification Search
CPC ..... G09G 3/3233; G09G 2330/08; G09G 2300/0819; G09G 2320/0209; G09G 3/3225; G09G 3/3266; G09G 3/20; G09G 3/3677; G09G 3/3692; G09G 2300/0852; G09G 2300/0861; G09G 2330/10
See application file for complete search history.

(56) References Cited

U.S. PATENT DOCUMENTS

2002/0011982 A1* 1/2002 Takeuchi ..... G09G 3/3677 345/92
2005/0110719 A1* 5/2005 Satoh ..... G09G 3/006 345/76
2006/0125807 A1* 6/2006 Park ..... G09G 3/3233 345/204
2011/0069061 A1* 3/2011 Nakamura ..... G09G 3/3225 345/214
2011/0227884 A1* 9/2011 Chung ..... G09G 3/3266 345/204

(Continued)

FOREIGN PATENT DOCUMENTS

KR 10-0666639 B1 1/2007
KR 10-2012-0122596 A 11/2012
KR 10-2014-0137504 A 12/2014

*Primary Examiner* — Richard Hong
(74) *Attorney, Agent, or Firm* — Lee & Morse, P.C.

(57) ABSTRACT

An organic light emitting display device includes display pixels, auxiliary pixels, and a plurality of signal lines. The signal lines include data lines, auxiliary data lines, scan lines, and emission control lines. The auxiliary pixels are to be used for repairing defective ones of the display pixels. In operation, scan signals are supplied in a unit of p scan lines, A emission control signals are to be supplied in a unit of p A emission control lines, and B emission control signals are to be supplied in a unit of p B emission control lines, where p≥2.

17 Claims, 10 Drawing Sheets

(56) References Cited

U.S. PATENT DOCUMENTS

| | | | | |
|---|---|---|---|---|
| 2011/0273417 | A1* | 11/2011 | Shin | G09G 3/20 345/211 |
| 2012/0182518 | A1* | 7/2012 | Ho | G09G 3/3233 349/192 |
| 2013/0208032 | A1* | 8/2013 | Jang | G09G 3/3233 345/694 |
| 2014/0168043 | A1* | 6/2014 | Zhang | G09G 3/3692 345/90 |
| 2016/0078810 | A1 | 3/2016 | Park et al. | |
| 2016/0104421 | A1 | 4/2016 | Park et al. | |
| 2016/0104431 | A1 | 4/2016 | Park et al. | |

* cited by examiner

ORGANIC LIGHT EMITTING DISPLAY DEVICE

CROSS-REFERENCE TO RELATED APPLICATION

Korean Patent Application No. 10-2014-0122730, filed on Sep. 16, 2014, and entitled, "Organic Light Emitting Display Device," is incorporated by reference herein in its entirety.

BACKGROUND

1. Field

One or more embodiments described herein relate to an organic light emitting display device.

2. Description of the Related Art

Consumer demand for improvements in flat panel displays continues to increase.

Examples of these displays include liquid crystal displays, plasma display panels, and organic light emitting displays.

An organic light emitting display includes pixels disposed in a matrix form at intersections of data lines and scan lines. A data driver supplies data voltages to the data lines, and a scan driver supplies scan signals to the scan lines. The display further includes a power supply unit for supplying a plurality of power voltages to the panel. In operation, each pixel emits light with brightness based on a controlled current flowing from a first power voltage to an organic light emitting diode. The controlled current corresponds to a data voltage supplied through a data line when a scan signal is supplied.

During manufacturing, a defect occur to one or more of transistors of the pixels. As a result, manufacturing yield deteriorates.

SUMMARY

In accordance with one embodiment, an organic light emitting display device includes data lines; auxiliary data lines; scan lines and emission control lines crossing the data lines and the auxiliary data lines; display pixels at corresponding intersections of the data lines, the scan lines, and the emission control lines; auxiliary pixels at corresponding intersections of the auxiliary data lines, the scan lines, and the emission control lines; and auxiliary lines connected to the auxiliary pixels, wherein scan signals are to be supplied in a unit of p scan lines, A emission control signals are to be supplied in a unit of p A emission control lines, and B emission control signals are to be supplied in a unit of p B emission control lines, wherein $p \geq 2$.

A same A emission control signal may be supplied to p A emission control lines, and a same B emission control signal may be supplied to p B emission control lines. The scan signals are to be sequentially supplied to p scan lines, and the scan signals are to be applied to have increasing pulse widths. A pulse width of the scan signal supplied to a $k+1^{th}$ scan line may be greater than a pulse width of the scan signal supplied to a $k^{th}$ scan line.

The auxiliary pixel may include a discharge transistor connected to the auxiliary line, and a first power voltage line to receive a first power voltage. The auxiliary pixel may include a plurality of transistors, and a discharge transistor controller to control the discharge transistor. The discharge transistor controller may include first and second discharge control transistors connected to a control electrode of the discharge transistor, and a control electrode of the first discharge control transistor and a control electrode of the second discharge control transistor may be connected to different lines.

The control electrode of the first discharge transistor may be connected to a pull-down control node of an emission stage connected to a corresponding one of the emission control lines, and the first discharge transistor may include a first electrode connected to a corresponding one of the scan lines, and a second electrode connected to the control electrode of the discharge transistor, wherein the control electrode and a second electrode of the second discharge control transistor may be connected to a corresponding one of the scan lines, and a first electrode of the second discharge control transistor may be connected to the control electrode of the discharge transistor.

The control electrode of the first discharge control transistor may be connected to a pull-down control node of an emission stage connected to a corresponding one of the emission control lines, and the first discharge control transistor may include a first electrode connected to a gate off voltage line to which a gate off voltage is supplied, and a second electrode connected to the control electrode of the discharge transistor, the control electrode of the second discharge control transistor may be connected to a corresponding one of the scan lines, and the second discharge control transistor may include a first electrode connected to the control electrode of the discharge transistor and a second electrode connected to a gate on voltage line to receive a gate on voltage.

The discharge transistor controller may include a first capacitor connected to the control electrode of the discharge transistor and a second power voltage line to receive a second power voltage. The auxiliary pixel may include an auxiliary pixel driver which includes a plurality of transistors, and the auxiliary pixel driver may supply a driving current to the auxiliary line.

The auxiliary pixel driver may include a first transistor to control the driving current according to a voltage of a control electrode; a second transistor connected to a corresponding one of the auxiliary data lines and a control electrode of the first transistor; a third transistor connected to a first electrode of the first transistor and a second power voltage line to which a second power voltage is supplied; a fourth transistor connected to a second electrode of the first transistor and the auxiliary line; a second capacitor connected to the control electrode and the first electrode of the first transistor; and a third capacitor connected to the first electrode of the first transistor and the second power voltage line.

The control electrode of the second transistor may be connected to a corresponding one of the scan lines, a control electrode of the third transistor may be connected to a corresponding one of the A emission control lines, and a control electrode of the fourth transistor may be connected to a corresponding one of the B emission control lines.

The display pixel may include an organic light emitting diode; and a display pixel driver including a plurality of transistors, the display pixel driver to supply a driving current to the organic light emitting diode.

The display pixel driver may include a first transistor to control the driving current according to a voltage of a control electrode; a second transistor connected to a corresponding one of the data lines and a control electrode of the first transistor; a third transistor connected to a first electrode of the first transistor and a second power voltage line to which a second power voltage is supplied; a fourth transistor connected to a second electrode of the first transistor and an anode electrode of the organic light emitting diode; a fifth transistor connected to the anode electrode of the organic light emitting diode and a third power voltage line to which a third power voltage is supplied; a second capacitor connected to the control electrode and first electrode of the first transistor; and a third capacitor connected to the first electrode of the first transistor and second power voltage line.

Control electrodes of the second and fifth transistors may be connected to a corresponding one of the scan lines, a control electrode of the third transistor may be connected to a corresponding one of the A emission control lines, and a control electrode of the fourth transistor may be connected to a corresponding one of the B emission control lines.

In accordance with another embodiment, a driver includes a generator to generate auxiliary data based on location information of a defective pixel to be repaired in a display; and a converter to adjust the auxiliary data to at least partially compensate for at least one of a wire resistance of an auxiliary line coupled to an auxiliary pixel circuit or a parasitic capacitance of the auxiliary line, wherein the generator is to generate the auxiliary data based on a repair control signal for the defective pixel.

The converter may adjust the auxiliary data to at least partially compensate for the wire resistance of the auxiliary line coupled to an auxiliary pixel circuit and the parasitic capacitance of the auxiliary line. The converter may add predetermined data to the auxiliary data, the predetermined data corresponding to at least one of the wire resistance of the auxiliary line coupled to the auxiliary pixel circuit or the parasitic capacitance of the auxiliary line. The location information may be a coordinate value of the defective pixel.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
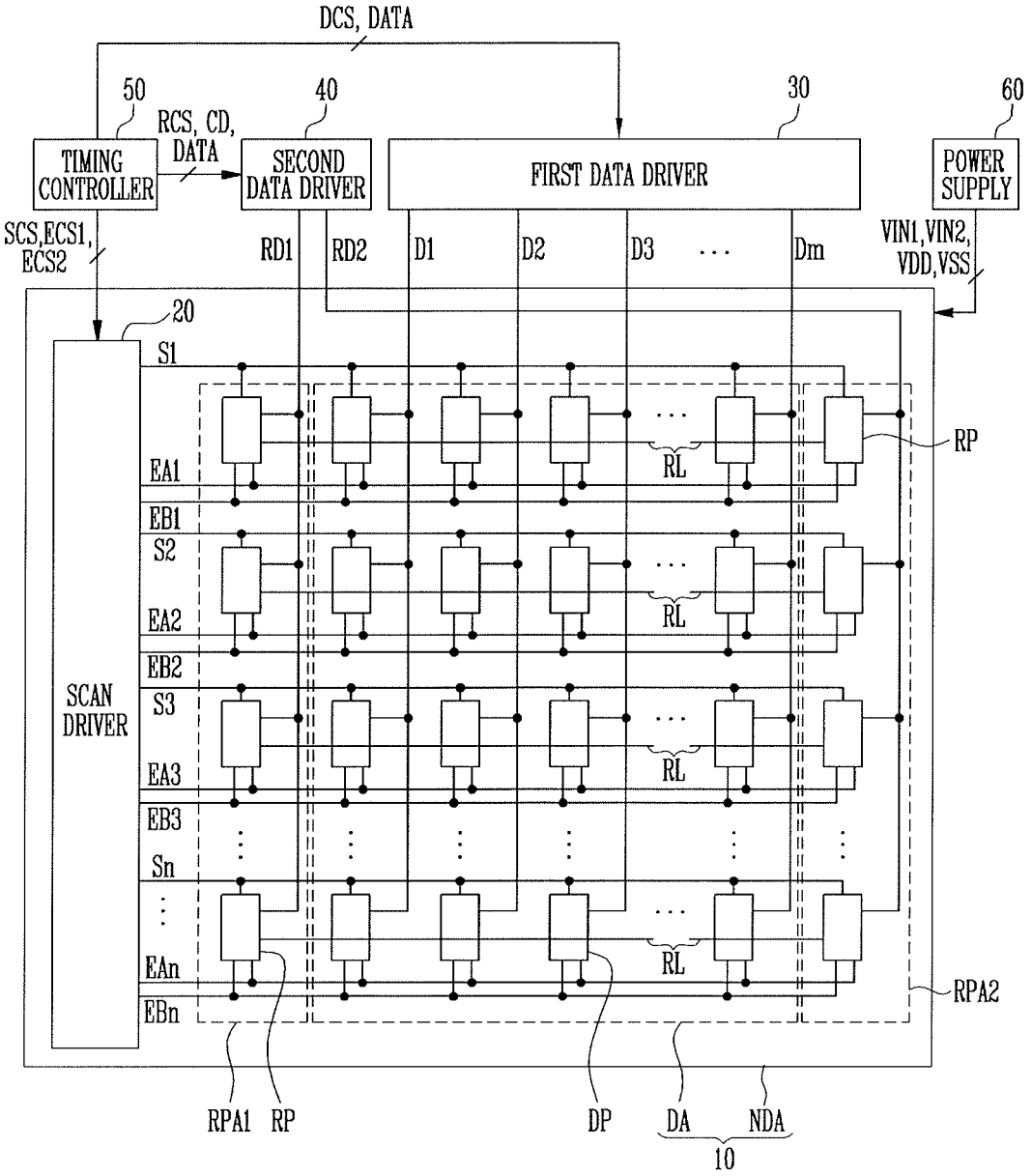
FIG. 1 illustrates an embodiment of an organic light emitting display device.

Example embodiments are described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art. In the drawings, the dimensions of layers and regions may be exaggerated for clarity of illustration. Like reference numerals refer to like elements throughout.

FIG. 1 illustrates an embodiment of an organic light emitting display device which includes a display panel 10, a scan driver 20, a first data driver 30, a second data driver 40, a timing controller 50, and a power supply 60.

Figure 2:
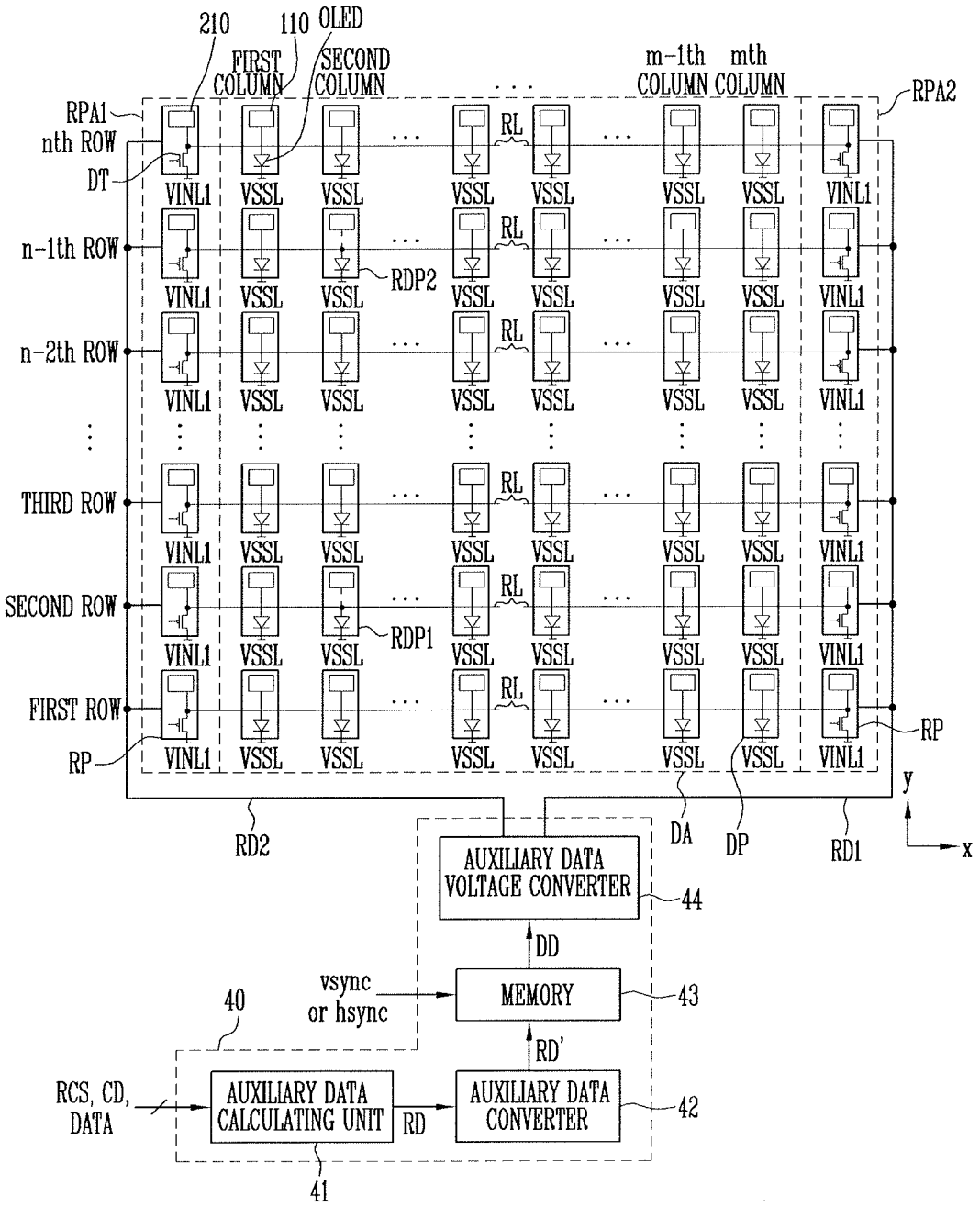
FIG. 2 illustrates an embodiment of display pixels and data driver.

The display panel 10 includes data lines D1 to Dm (m is a positive integer equal to or greater than 2), auxiliary data lines RD1 and RD2, scan lines S1 to Sn (n is a positive integer equal to or greater than 2), A emission control lines EA1 to EAn, and B emission control lines EB1 to EBn. The data lines D1 to Dm and the auxiliary data lines RD1 and RD2 may be formed in parallel to each other. The auxiliary data lines RD1 and RD2 may be formed at outer sides of both sides of the data lines D1 to Dm. For example, as illustrated in FIG. 2, the first auxiliary data line RD1 may be formed at an outer side of one side of the data lines D1 to Dm, and the second auxiliary data line RD2 may be formed at an outer side of the other side of the data lines D1 to Dm.

The data lines D1 to Dm and the scan lines S1 to Sn may be formed to cross each other. The auxiliary data lines RD1 and RD2 and the scan lines S1 to Sn may also be formed to cross each other. The scan lines S1 to Sn and the first and B emission control lines EA1 to EAn and EB1 to EBn may be formed in parallel to each other.

The display panel 10 includes a display area DA, in which display pixels DPs for displaying an image are formed, and a non-display area NDA corresponding to an area except for the display area DA. The non-display area NDA may include first and second auxiliary pixel areas RPA1 and RPA2, in which auxiliary pixels RPs for repairing the display pixels DPs are formed. The auxiliary pixels RPs connected to a first auxiliary data line RD1 may be formed in a first auxiliary pixel area RPA1. The auxiliary pixels RPs connected to a second auxiliary data line RD2 may be formed in a second auxiliary pixel area RPA2.

The display pixels DPs may be disposed in a matrix form at intersections of the data lines D1 to Dm and the scan lines S1 to Sn in the display area DA. Each of the display pixels DPs are connected to corresponding ones of the data lines, scan lines, A emission control lines, and one B emission control lines.

The auxiliary pixels RPs may be disposed at intersections of the auxiliary data lines DR1 and RD2 and the scan lines S0 to Sn in each of the auxiliary pixel areas RPA1 and RPA2. The auxiliary pixels RPs are pixels to be used for repairing the display pixels DPs, which, for example, have a defect produced during a process of manufacturing the display panel 10. Each of the auxiliary pixels RPs may be connected to corresponding ones of the auxiliary data lines, a pair of scan lines, emission control lines, and auxiliary lines RL. The auxiliary line RL is connected to the auxiliary pixel RP and extends to the display area DA from the auxiliary pixel RP for crossing the display pixels DPs.

When a defect occurs in a display pixel DP, the defective display pixel DP is connected to the auxiliary line RL, for example, through a laser short-circuit process. A corresponding auxiliary pixel RP is connected to the defective display pixel DP through the auxiliary line RL, to effect repair of the defective display pixel DP using the auxiliary pixel RP. (A defective display pixel DP which has been repaired may be referred to as a repaired pixel).

The display panel 10 may include a plurality of power voltage lines to supply a plurality of power voltages to the display pixels DPs and the auxiliary pixels RPs.

The scan driver 20 includes a scan signal output unit for outputting scan signals to the scan lines S1 to Sn, an A emission control signal output unit for outputting emission control signals to the A emission control lines EA1 to EAn, and a B emission control signal output unit for outputting emission control signals to the B emission control lines EB1 to EBn.

The scan signal output unit receives a scan timing control signal SCS from the timing controller 50, and outputs the scan signals to the scan lines S1 to Sn according to the scan timing control signal SCS.

The A emission control signal output unit receives an A emission timing control signal ECSA from the timing controller 50, and outputs the A emission control signals to the A emission control lines EA1 to EAn according to the A emission timing control signal ECSA.

The B emission control signal output unit receives a B emission timing control signal ECSB from the timing controller 50, and outputs the B emission control signals to the B emission control lines EB1 to EBn according to the B emission timing control signal ECSB.

The scan signal output unit and the first and B emission control signal output units may be formed, for example, in an Amorphous Silicon Gate in Pixel (AGS) scheme or a Gate Driver in Panel (GIP) scheme in the non-display area NDA of display panel 10.

The first data driver 30 includes at least one source drive Integrated Circuit (IC). The source drive IC receives digital video data DATA and a source timing control signal DCS from the timing controller 50. The source drive IC converts the digital video data DATA to data voltages in response to a source timing control signal DCS. The source drive IC synchronizes the scan signals and the data voltages, respectively, and supplies the synchronized data voltages to the data lines D1 to Dm. Accordingly, the data voltages are supplied to the display pixels DPs, to which the scan signal is supplied.

The second data driver 40 receives a repair control signal RCS, the digital video data DATA, and coordinate data CD of the repaired pixel from the timing controller 50. The second data driver 40 generates auxiliary data voltages using the repair control signal RCS, the digital video data DATA, and the coordinate data CD of the repaired pixel. The second data driver 40 synchronizes the auxiliary data voltages and the scan signals, respectively, and supplies the synchronized auxiliary data voltages to the auxiliary data lines RD1 and RD2. Accordingly, the auxiliary data voltages are supplied to the auxiliary pixels RPs, to which the scan signal is supplied.

For example, the second data driver 40 supplies the same auxiliary data voltage as the data voltage, which is to be supplied to the repaired pixel, to the auxiliary pixel connected to the repaired pixel in order to repair the repaired pixel. Examples of the supply of the auxiliary data voltage by the second data driver 40 will be described with reference to FIGS. 2, 3, and 4A and 4B.

The timing controller 50 receives the digital video data DATA and timing signals from an external source. The timing controller 50 generates timing control signals for controlling the scan driver 20 and the first data driver 30 based on the timing signals. The timing control signals include the scan timing control signal SCS for controlling an operation timing of the scan signal output unit of the scan driver 20, the A emission timing control signal ECSA for controlling an operation timing of the A emission control signal output unit of the scan driver 20, the B emission timing control signal ECSB for controlling an operation timing of the B emission control signal output unit of the scan driver 20, and the data timing control signal DCS for controlling an operation timing of the first data driver 30. The timing controller 50 outputs the scan timing control signal SCS, and the A and B emission timing control signals ECSA and ECSB to the scan driver 20, and the data timing control signal DCS and the digital video data DATA to the first data driver 30.

Further, the timing controller 50 generates the repair control signal RCS and the coordinate data CD of a repaired pixel. The repair control signal RCS is a signal indicating whether the repaired pixel exists. For example, when a pixel has been repaired, the repair control signal RCS may be generated to have a first logic level voltage. Otherwise, the repair control signal RCS may be generated to have a second logic level voltage.

The coordinate data CD of the repaired pixel is a signal indicating a coordinate value of the repaired pixel. The coordinate data CD of the repaired pixel may be stored in a memory of the timing controller 50. The timing controller 50 outputs the repair control signal RCS, the coordinate data CD of the repaired pixel, and the digital video data DATA to the second data driver 40.

The power supply 60 may supply a plurality of power voltages to the plurality of power voltage lines. For example, the power supply 60 may supply first to fourth power voltages VIN1, VDD, VIN2, and VSS to the first to fourth power voltage lines. Examples of the first to fourth power voltage lines will be described with reference to FIGS. 2 and 8. Further, the power supply 60 may supply a gate off voltage to a gate off voltage line and supply a gate on voltage to a gate on voltage line. Examples of the gate off voltage and the gate on voltage will be described with reference to FIGS. 6, 7, and 9.

FIG. 2 illustrates embodiments of the display pixels, the auxiliary pixels, the auxiliary lines, the auxiliary data lines, and the second data driver. In FIG. 2, only the display pixels DPs, the auxiliary pixels RPs, the auxiliary lines RLs, the auxiliary data lines RD1 and RD2, and the second data driver 40 of the display panel 10 are illustrated for convenience of the description.

Referring to FIG. 2, each of the display pixels DPs includes a display pixel driver 110 and an organic light emitting diode OLED. The organic light emitting diode OLED emits light with predetermined brightness based on a driving current of the display pixel driver 110. The organic light emitting diode OLED has an anode connected to the display pixel driver 110, and a cathode electrode connected to a fourth power voltage line VSSL to which a fourth power voltage is supplied. The fourth power voltage may be a low potential power voltage.

Each auxiliary pixel RP includes an auxiliary pixel driver 210 and a discharge transistor DT. The auxiliary pixel driver 210 and the discharge transistor DT are connected to the auxiliary line RL. The auxiliary pixel driver 210 supplies a driving current to the auxiliary line RL. The discharge transistor DT discharges the auxiliary line RL with the first power voltage. The discharge transistor DT may be connected to the auxiliary line RL and a first power voltage line VINL1 for supplying the first power voltage. A control electrode of the discharge transistor DT may be connected to a discharge transistor controller.

The auxiliary line RL is connected to the auxiliary pixel RP and extends to the display area DA from the auxiliary pixel RP to cross the display pixels DPs. For example, in FIG. 2, the auxiliary line RL is connected to the auxiliary pixel RP in a $p^{th}$ row (p is a positive integer satisfying $1 \le p \le n$), and crosses the display pixels DPs in the $p^{th}$ row.

Further, in FIG. 2, the auxiliary line. RL crosses the anode electrodes of the organic light emitting diodes OLEDs of the display pixels DPs.

The auxiliary line RL may be connected to one or more of the display pixels DPs of the display area DA. A display pixel DP is connected to the auxiliary line RL when the display pixel DP is defective and needs to be repaired. In FIG. 2, the display pixel DP connected to the auxiliary line RL is defined as a repaired pixel RDP1/RDP2. For example, the auxiliary line RL may be connected to the anode electrode of the organic light emitting diode OLED of the repaired pixel RDP1/RDP2. In this case, the display pixel driver 110 and the organic light emitting diode OLED of the repaired pixel RDP1/RDP2 are disconnected.

The auxiliary pixels RPs of the first auxiliary pixel area RP1 are connected to the first auxiliary data line RD1. The auxiliary pixels RPs of the second auxiliary pixel area RP2 are connected to the second auxiliary data line RD2. The display pixels DPs of the display area DA are connected to the data lines D1 to Dm.

The second data driver 40 includes an auxiliary data calculating unit 41, an auxiliary data converter 42, a memory 43, and an auxiliary data voltage converter 44. An example of a driving method of the second data driver 40 is described with reference to FIGS. 2 and 3.

Figure 3:
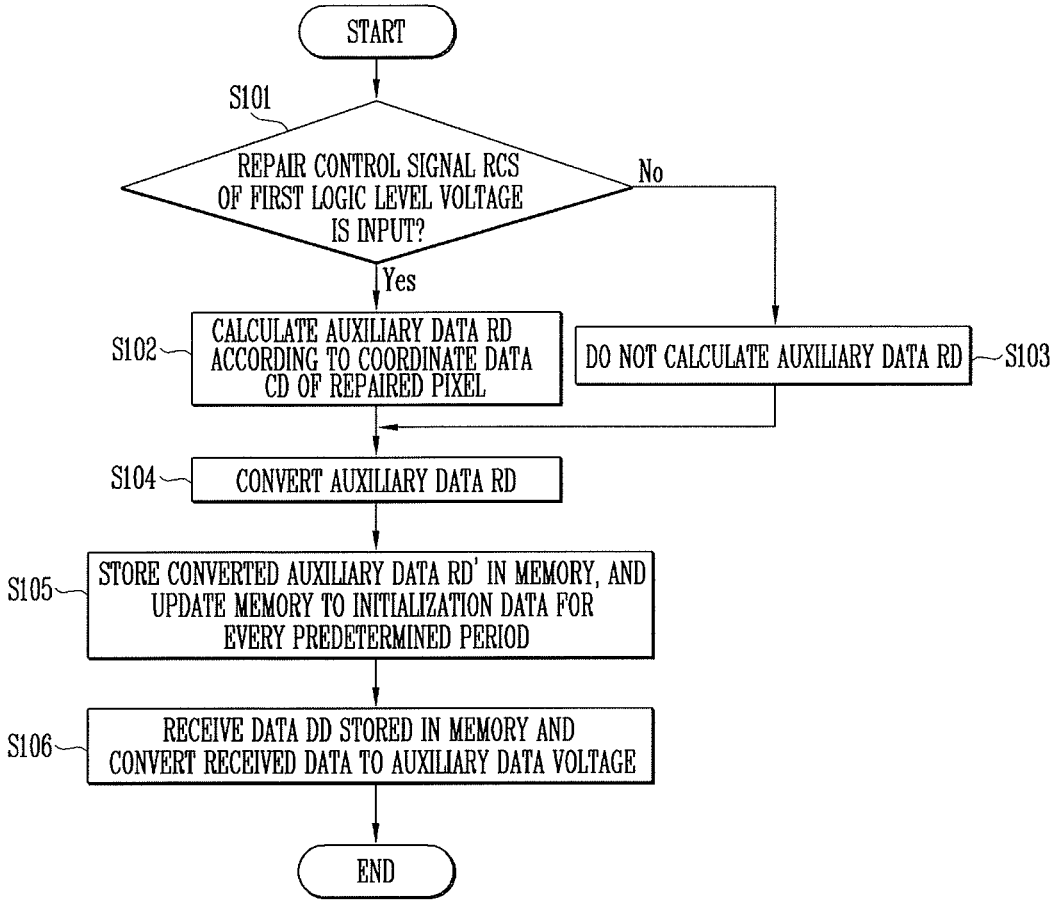
FIG. 3 illustrates an embodiment of a method for driving a data driver.

FIG. 3 illustrate an embodiment of a method for driving a data driver, which, for example, may be the second data driver 40 of FIG. 2. Referring to FIG. 3, a driving method of the second data driver includes operations S101 to S106.

First, the auxiliary data calculating unit 41 receives the repair control signal RCS, the digital video data DATA, and the coordinate data CD of the repaired pixel RDP1/RDP2 from the timing controller 50. The auxiliary data calculating unit 41 calculates auxiliary data RD when the repair control signal RCS of the first logic level voltage is input, and does not calculate the auxiliary data RD when the repair control signal RCS of the second logic level voltage is input. For example, when the repair control signal RCS of the first logic level voltage is input, the auxiliary data calculating unit 41 calculates the auxiliary data RD from the digital video data DATA according to the coordinate data CD of the repaired pixel.

The auxiliary data calculating unit 41 may calculate the digital video data corresponding to a coordinate value of the repaired pixel RDP1/RDP2 as the auxiliary data RD. For example, when the first repaired pixel RDP1 is positioned in the second row and the second column as illustrated in FIG. 2, a coordinate value of the first repaired pixel RDP1 may be (2, 2). In FIG. 2, only the row and the column of the display area DA is illustrated for brevity. When n display pixels DPs are disposed in the column direction (an y-axis direction of FIG. 2), the second repaired pixel RDP2 may be positioned in the $n-1^{th}$ row and the second column, and a coordinate value of the second repaired pixel RDP2 may be (n−1, 2).

The auxiliary data calculating unit 41 may calculate digital video data corresponding to the coordinate value (2, 2) as the auxiliary data RD, which is to be supplied to the auxiliary pixel RP connected to the first repaired pixel RDP1. The auxiliary data calculating unit 41 may calculate digital video data corresponding to the coordinate value (n−1, 2) as the auxiliary data RD, which is to be supplied to the auxiliary pixel RP connected to the second repaired pixel RDP2. The auxiliary data calculating unit 41 outputs the calculated auxiliary data RD to the auxiliary data converter 42 (S101, S102, S103).

Second, the auxiliary data converter 42 receives the auxiliary data RD from the auxiliary data calculating unit 41. In this case, the repaired pixel RDP1/RDP2 receives the auxiliary data voltage from the auxiliary pixel RP through the auxiliary line RL. Accordingly, the auxiliary data converter 42 may convert the auxiliary data RD by adding predetermined data to the auxiliary data RD considering wire resistance of the auxiliary line RL and parasitic capacitance formed in the auxiliary line RL. The auxiliary data converter 42 outputs converted auxiliary data RD' to the memory 43.

In one embodiment, the auxiliary data converter 42 may be omitted. In this case, the auxiliary data calculating unit 41 outputs the auxiliary data RD to memory 43 (S104).

Third, the memory 43 receives and stores the converted auxiliary data RD' from the auxiliary data converter 42. When auxiliary data converter 42 is omitted, the memory 43 receives and stores the auxiliary data from the auxiliary data calculating unit 41.

The memory 43 may be set to be updated to have initialization data for every predetermined period. For example, the memory 43 may receive a signal indicating a predetermined period from the timing controller 50. The signal indicating this predetermined period may be, for example, a vertical sync signal vsync for generating a pulse for every one frame period or a horizontal sync signal hsync for generating a pulse for every one horizontal frame period.

The one frame period may correspond to a period for which the data voltages are supplied to all of the display pixels DPs. The one horizontal period may correspond to a period for which the data voltages are supplied to the display pixels DPs of any one row. When the signal indicating a predetermined period is the vertical sync signal vsync, the memory 43 may be updated to have the initialization data for every one frame period. When the signal indicating a predetermined period is the horizontal sync signal hsync, the memory 43 may be updated to have the initialization data for every one horizontal period. The memory 43 may be implemented as, or may include, a register. The memory 43 outputs data DD stored therein to the auxiliary data voltage converter 44 (S105).

Fourth, the auxiliary data voltage converter 44 receives the data DD stored in the memory 43 and converts the received data DD to the auxiliary data voltage. The auxiliary data voltage converter 44 synchronizes the auxiliary data voltages and the scan signals, respectively, and supplies the synchronized auxiliary data voltages to the auxiliary data lines RD1 and RD2. Accordingly, the auxiliary data voltages supplied to the auxiliary data lines RD1 and RD2 are synchronized with the data voltages supplied to the data lines D1 to Dm to be supplied. For example, the auxiliary data voltage supplied to the auxiliary pixel RP of the $p^{th}$ row is synchronized to the data voltages supplied to the display pixels DPs of the $p^{th}$ row to be supplied (S106).

As described above, in the present embodiment, the digital video data DATA corresponding to the coordinate value of the repaired pixel RDP1/RDP2 corresponds to the auxiliary data RD. As a result, the same auxiliary data voltage as the data voltage, which is to be supplied to the repaired pixel RDP1/RDP2, is supplied to the auxiliary pixel RP connected to the repaired pixel RDP1/RDP2.

Figure 4A:
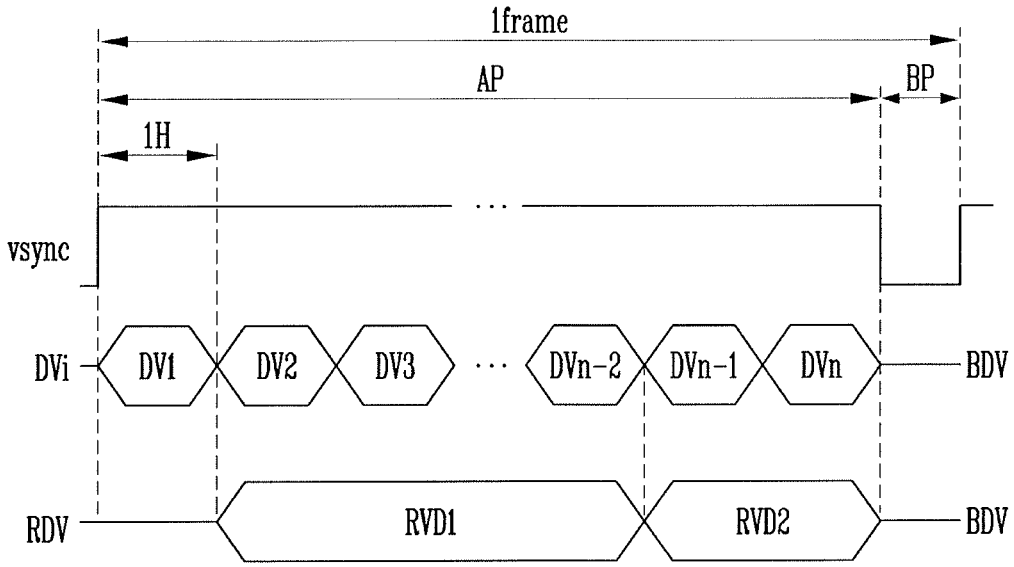
FIGS. 4A and 4B illustrate examples of voltages for a display device.

FIG. 4A illustrates an example of data voltages from the first data driver and auxiliary data voltages from the auxiliary data voltage converter of the second data driver of FIG. 2. FIG. 4A illustrates the vertical sync signal vsync, data voltages DVi output to an $i^{th}$ data line Di (i is a positive integer satisfying $1 \le i \le m$), and auxiliary data voltages RDV output from the auxiliary data voltage converter 44.

Referring to FIG. 4A, one frame period (1 frame) includes an active period AP for which the data voltages are supplied to the display pixels DPs, and a blank period BP that is an idle period. In the vertical sync signal vsync, a pulse is generated on a cycle of one frame period (1 frame). The data voltages DVi output to the $i^{th}$ data line Di may include first to $n^{th}$ data voltages DV1 to DVn. In this case, as illustrated in FIG. 2, the auxiliary data voltage supplied to the auxiliary pixel RP of the $p^{th}$ row may be synchronized to the data voltages supplied to the display pixels DPs of the $p^{th}$ row to be supplied.

As illustrated in FIG. 2, the first repaired pixel RDP1 may be positioned in the second row, and the second repaired pixel RDP2 may be positioned in the $n-1^{th}$ row. In this case, as illustrated in FIG. 4A, in the memory 43, a first auxiliary data voltage RDV1 may be supplied to the auxiliary data line RD1/RD2 while being synchronized to a period for which a data voltage DV2 is supplied to the $i^{th}$ data line Di in the display pixel of the second row. In this case, as illustrated in FIG. 4A, the second auxiliary data voltage RDV2 may be supplied to the auxiliary data line RD1/RD2 while being synchronized to a period for which a data voltage DVn−1 is supplied to the $i^{th}$ data line Di in the display pixel of the $n-1^{th}$ row.

When the signal indicating the predetermined period is the vertical sync signal vsync, the memory 43 may be updated to have the initialization data BD for every one frame period. Accordingly, as illustrated in FIG. 4A, the auxiliary data voltage converter 44 may receive the first auxiliary data RD1 from the memory 43 from a period, for which the data voltage DV2 is supplied to the display pixel of the second row, to a period, for which the data voltage DVn−2 is supplied to the display pixel of the $n-2^{th}$ row, and convert the input first auxiliary data RD1 to the first auxiliary data voltage RDV1 and output the first auxiliary data voltage RDV1 to the auxiliary data line RD1/RD2.

Further, as illustrated in FIG. 4A, the auxiliary data voltage converter 44 may receive the second auxiliary data RD1 from the memory 43 from a period, for which the data voltage DVn−1 is supplied to the display pixel of the $n-1^{th}$ row, to a period, for which the data voltage DVn is supplied to the display pixel of the $n^{th}$ row, convert the second auxiliary data RD2 to the second auxiliary data voltage RDV2, and output the second auxiliary data voltage RDV2 to the auxiliary data line RD1/RD2.

Further, as illustrated in FIG. 4A, the auxiliary data voltage converter 44 may receive the initialization data BD from the memory 43 for the period, for which the data voltage DV1 is supplied to the display pixel of the first row, convert the input initialization data BD to initialization data voltage BDV, and output the initialization data voltage BDV to the auxiliary data line RD1/RD2.

As a result, as illustrated in FIG. 4A, the auxiliary data voltages supplied to the auxiliary data lines RD1 and RD2 may be synchronized with the data voltages supplied to the data lines D1 to Dm to be supplied.

Figure 4B:
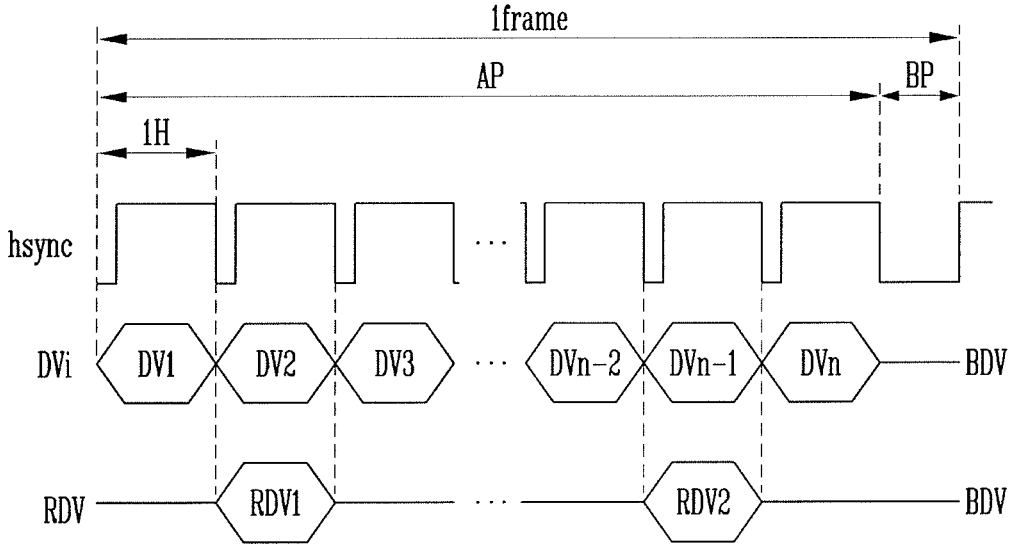

FIG. 4B is diagram illustrates an example of data voltages from the first data driver, and auxiliary data voltages from the auxiliary data voltage converter of the second data driver of FIG. 2. FIG. 4B illustrates the horizontal sync signal hsync, the data voltages DVi output to the $i^{th}$ data line, and the auxiliary data voltages RDV output from the auxiliary data voltage converter 44.

Referring to FIG. 4B, one frame period (1 frame) includes an active period AP for which the data voltages are supplied, and a blank period BP that is an idle period. In the horizontal sync signal hsync, a pulse is generated on a cycle of one horizontal period (1H). The data voltages DVi output to the $i^{th}$ data line Di may include first to $n^{th}$ data voltages DV1 to DVn. In this case, as illustrated in FIG. 2, the auxiliary data voltage supplied to the auxiliary pixel RP of the $p^{th}$ row may be synchronized to the data voltages supplied to the display pixels DPs of the $p^{th}$ row to be supplied.

As illustrated in FIG. 2, the first repaired pixel RDP1 may be positioned in the second row, and the second repaired pixel RDP2 may be positioned in the $n-1^{th}$ row. In this case, as illustrated in FIG. 4B, the first auxiliary data voltage RDV1 may be supplied to the auxiliary data line RD1/RD2 while being synchronized to a period for which the data voltage DV2 is supplied to the $i^{th}$ data line Di in the display pixel of the second row. In this case, as illustrated in FIG. 4B, the second auxiliary data voltage RDV2 may be supplied to the auxiliary data line RD1/RD2 while being synchronized to a period for which a data voltage DVn−1 is supplied to the $i^{th}$ data line Di in the display pixel of the $n-1^{th}$ row.

When the signal indicating the predetermined period is the horizontal sync signal hsync, the memory 43 may be updated to have the initialization data BD for every one horizontal period (1H). Accordingly, as illustrated in FIG. 4B, the auxiliary data voltage converter 44 may receive the first auxiliary data RD1 from the memory 43 only for a period, for which the data voltage DV2 is supplied to the display pixel of the second row, convert the input first auxiliary data RD1 to the first auxiliary data voltage RDV1, and output the first auxiliary data voltage RDV1 to the auxiliary data line RD1/RD2.

Further, as illustrated in FIG. 4B, the auxiliary data voltage converter 44 may receive the second auxiliary data RD2 from the memory 43 only for a period, for which the data voltage DVn−1 is supplied to the display pixel of the $n-1^{11}$ row, convert the second auxiliary data RD2 to the second auxiliary data voltage RDV2, and output the second auxiliary data voltage RDV2 to the auxiliary data line RD1/RD2.

Further, as illustrated in FIG. 4B, the auxiliary data voltage converter 44 may receive the initialization data BD from the memory 43 for the remaining periods, except for the period, for which the data voltage DV2 is supplied to the display pixel of the second row, and the period, for which the data voltage DVn−1 is supplied to the display pixel of the $n-1^{th}$ row, and convert the input initialization data BD to the initialization data voltage BDV, and output the initialization data voltage BDV to the auxiliary data line RD1/RD2.

As a result, as illustrated in FIG. 4B, the auxiliary data voltages supplied to the auxiliary data lines RD1 and RD2 are synchronized with the data voltages supplied to the data lines D1 to Dm to be supplied.

Further, as described with reference to FIG. 4B, the initialization data voltage BDV may be supplied to the auxiliary pixels which are not connected to the repaired pixels RDP1 and RDP2. As a result, in the present embodiment, it is possible to prevent the display pixels DPs of the display area from being influenced by a change in a voltage of the auxiliary lines connected to the auxiliary pixels which are not connected to the repaired pixels RDP1 and RDP2. When the auxiliary pixel RP receives the auxiliary data voltage, it is possible to supply the driving current to the auxiliary line RL to prevent the voltage of the auxiliary line RL from being changed.

Figure 5:
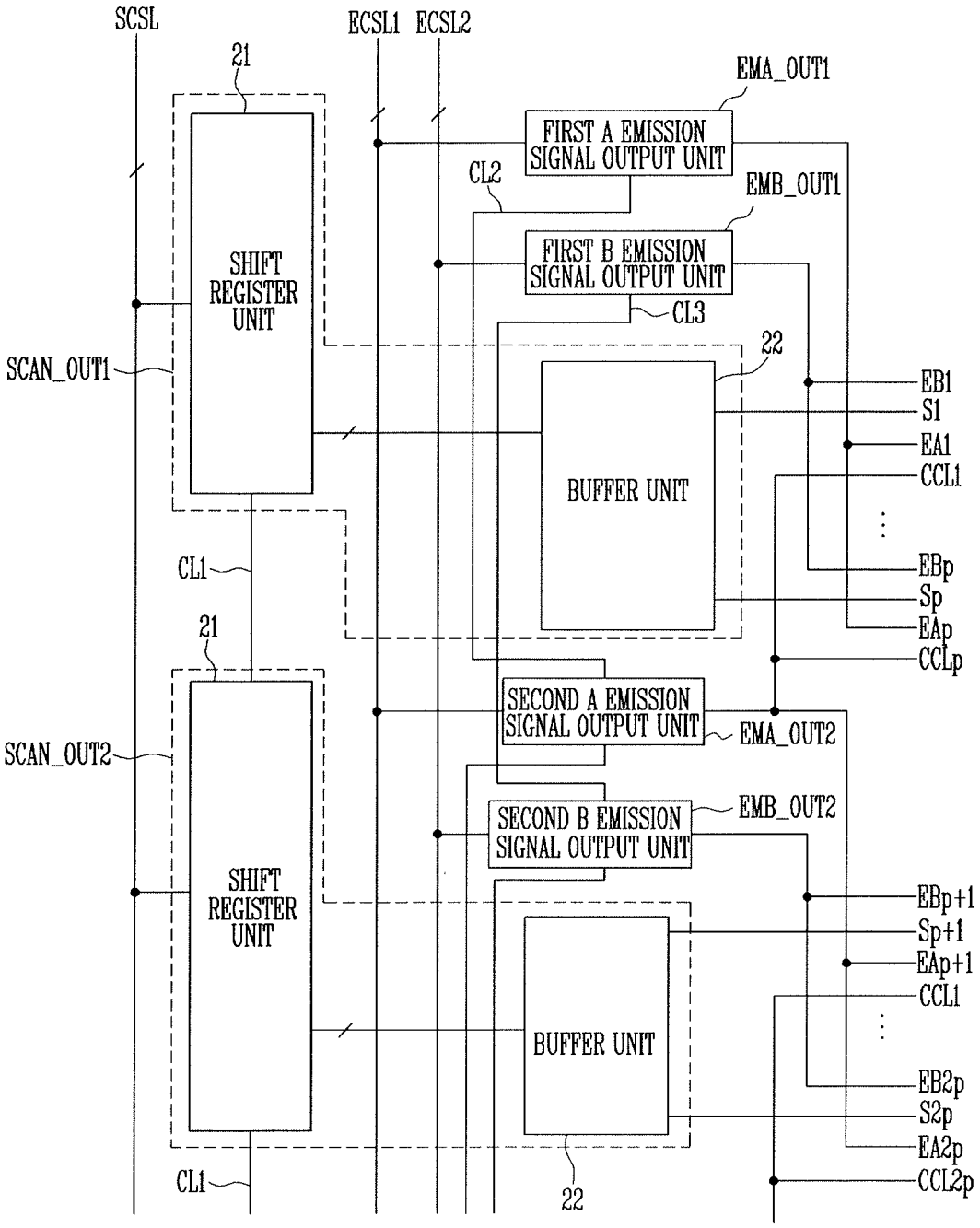
FIG. 5 illustrates an embodiment of a scan driver.

FIG. 5 illustrates an embodiment of a scan driver, which, for example, may correspond to scan driver 20. Referring to FIG. 5, the scan driver 20 includes a scan signal output unit, an A emission control signal output unit, and a B emission control signal output unit. The scan signal output unit includes a plurality of scan signal output units, and the A emission control signal output unit includes a plurality of A emission control signal output units, and the B emission control signal output unit includes a plurality of B emission control signal output units. For convenience of the description, FIG. 5 illustrates only first and second scan signal output units SCAN_OUT1 and SCAN_OUT2, first and 2A emission control signal output units EMA_OUT1 and EMA_OUT2, and first and 2B emission control signal output units EMB_OUT1 and EMB_OUT2.

Each scan signal output unit is connected to p scan lines (p is a positive integer equal to or greater than 2) and outputs scan signals to the plurality of scan lines. For example, the scan signals are supplied in a unit of p scan lines. For example, the first scan signal output unit SCAN_OUT1 is connected to first to $p^{th}$ scan lines S1 to Sp, and outputs the scan signal to each of the first to $p^{th}$ scan lines S1 to Sp as illustrated in FIG. 5. The second scan signal output unit SCAN_OUT2 is connected to $p+1^{th}$ to $2p^{th}$ scan lines Sp+1 to S2*p*, and outputs the scan signal to each of the $p+1^{th}$ to $2p^{th}$ scan lines Sp+1 to S2*p* as illustrated in FIG. 5. Examples of first to $p^{th}$ scan signals SCAN1 to SCANp output to the first to $p^{th}$ scan lines S1 to Sp and $p+1^{th}$ to $2p^{th}$ scan signals SCANp+1 to SCAN2*p* output to the $p+1^{th}$ to $2p^{th}$ scan lines Sp+1 to S2*p* are described with reference to FIG. 7.

Each of the plurality of scan signal output units includes a shift register unit 21 and a buffer unit 22. The shift register unit 21 receives the scan timing control signal SCS through a scan timing control line SCSL, and outputs output signals sequentially shifted according to the scan timing control signal SCS to the buffer unit 22. Further, the shift register unit 21 outputs a carry signal to the shift resister unit 21 at a rear end thereof through a first carry signal line CL1. For example, the shift register unit 21 of the first scan signal output unit SCAN_OUT1 outputs the carry signal to the shift resister 21 of the second scan signal output unit SCAN_OUT2 through first carry signal line CL1.

The buffer unit 22 generates scan signals by using the output signals supplied from the shift register unit 21. The buffer unit 22 supplies the generated scan signals to the p scan lines. Accordingly, the scan signals are supplied in the unit of p scan lines.

Each of the plurality of A emission control signal output units is connected to p A emission control lines and supplies the A emission control signals to the p A emission control lines. For example, the A emission control signals are supplied in the unit of p A emission control lines. In one embodiment, the first A emission control signal output unit EMA_OUT1 is connected to the first to $p^{th}$ A emission control lines EA1 to EAp, and outputs the A emission control signals to the first to $p^{th}$ A emission control lines EA1 to EAp as illustrated in FIG. 5. The second A emission control signal output unit EMA_OUT2 is connected to the $p+1^{th}$ to $2p^{th}$ A emission control lines EAp+1 to EA2p, and outputs the A emission control signal to each of the $p+1^{th}$ to $2p^{th}$ A emission control lines EAp+1 to EA2p as illustrated in FIG. 5. Examples of the first A emission control signal EMA1 output to the first to $p^{th}$ A emission control lines EA1 to EAp and the second A emission control signal EMA2 output to the $p+1^{th}$ to $2p^{th}$ A emission control lines EAp+1 to EA2p are described with reference to FIG. 7.

Further, each of the plurality of A emission control signal output outputs the carry signal to the A emission control signal output unit at a rear end thereof through a second carry signal line CL2. For example, the first A emission control signal output unit EMA_OUT1 outputs the carry signal to the second A emission control signal output unit EMA_OUT2 through the second carry signal line CL2 as illustrated in FIG. 5.

Each of the plurality of B emission control signal output units is connected to p B mission control lines and supplies the B emission control signal to the p B emission control lines. For example, the B emission control signals are supplied in the unit of p B emission control lines. In one embodiment, the first B emission control signal output unit EMB_OUT1 is connected to the first to $p^{th}$ emission control lines EB1 to EBp, and outputs the B emission control signals to the first to $p^{th}$ B emission control lines EB1 to EBp as illustrated in FIG. 5.

Further, the second B emission control signal output unit EMB_OUT2 is connected to the $p+1^{th}$ to $2p^{th}$ B emission control lines EBp+1 to EB2*p*, and outputs the B emission control signal to each of the $p+1^{th}$ to $2p^{th}$ B emission control lines EBp+1 to EB2p as illustrated in FIG. 5. Examples of the first B emission control signal EMB1 output to the first to $p^{th}$ B emission control lines EB1 to EBp and the second B emission control signal EMB2 output to the $p+1^{th}$ to $2p^{th}$ B emission control lines EBp+1 to EB2p are described with reference to FIG. 7.

Further, each of the plurality of B emission control signal output outputs the carry signal to the B emission control signal output unit at a rear end thereof through a third carry signal line CL3. For example, the first B emission control signal output unit EMB_OUT1 outputs the carry signal to the second B emission control signal output unit EMB_OUT2 through the third carry signal line CL3.

Control lines parallel to the scan lines S1 to Sn, the A emission control lines EMA1 to EMAn, and the B emission control lines EMB1 to EMBn may be formed in the display panel 10, for example, as illustrated in FIG. 1. In this case, each of the display pixels DP may be connected to corresponding ones of the scan lines, A emission control lines, and B emission control lines. Each of the auxiliary pixels RP may be connected to corresponding ones of the scan lines. A emission control lines. B emission control lines, and control lines.

A pull-down control node of each of the plurality of A emission control signal output units may be connected to p control lines. An example of the pull-down control node of each A emission control signal output unit is described with reference to FIG. 6.

In one embodiment, the pull-down control node of a $q^{th}$ A emission control signal output unit EMA_OUTq (q is a positive integer equal to or greater than 2) is connected to p control lines adjacent to the A emission control lines connected to a $q-1^{th}$ A emission control signal output unit EMA_OUTq. For example, as illustrated in FIG. 5, the pull-down control node of the second A emission control signal output unit EMA_OUT2 may be connected to a first to $p^{th}$ control lines CCL1 to CCLp adjacent to the first to $p^{th}$ A emission control lines EA1 to EAp connected to the first A emission control signal output unit EMA_OUT1.

Otherwise, the pull-down control node of the $q^{th}$ B emission control signal output unit EMB_OUTq may be connected to p control lines adjacent to the A emission control lines connected to the $q-1^{th}$ B emission control signal output unit EMA_OUTq. For example, as illustrated in FIG. 5, the pull-down control node of the second B emission control signal output unit EMB_OUT2 may be connected to the first to control lines CCL1 to CCLp adjacent to the first to $p^{th}$ B emission control lines EB1 to EBp connected to the first B emission control signal output unit EMB_OUT1.

Figure 6:
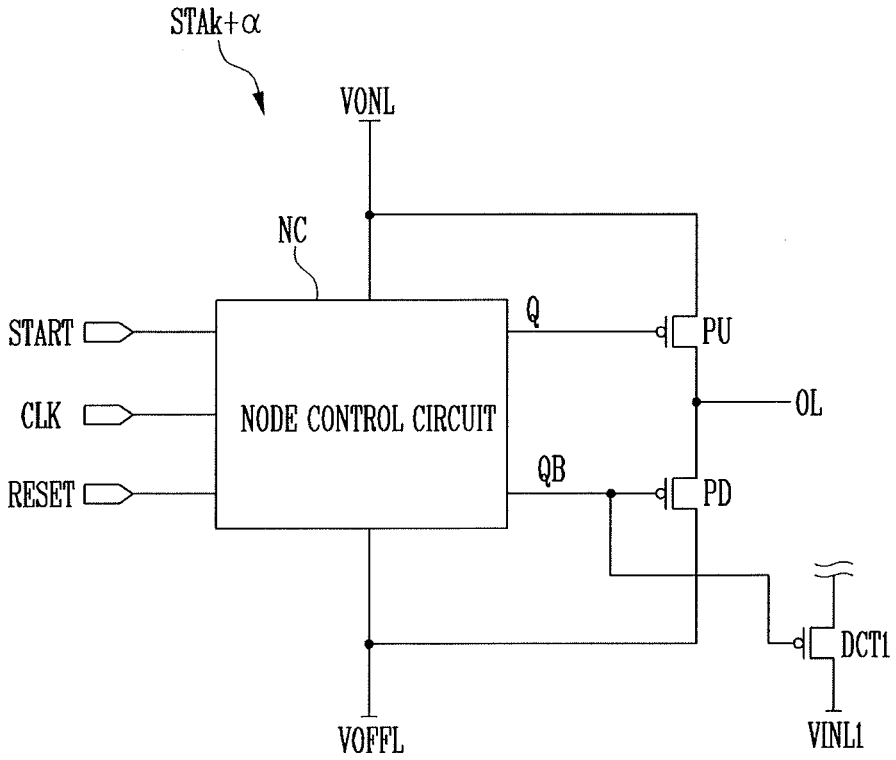
FIG. 6 illustrates an example of a first A emitting control signal output unit.

FIG. 6 illustrates an example of the second A emitting control signal output unit of FIG. 5. Referring to FIG. 6, the second A emitting control signal output unit (EMA_OUT2) includes a pull-up control node Q, a pull-down control node QB, a pull-up transistor TU, a pull-down transistor TD, and a node control circuit NC.

The pull-up transistor TU controls a connection of a gate on voltage line VONL and an output line OL according to a voltage of the pull-up control node Q. The output line OL of the second A emission control signal output unit EMA_OUT2 is connected to the $p+1^{th}$ to $2p^{th}$ A emission control lines EAp+1 to EA2p as illustrated in FIG. 5. A control electrode of the pull-up transistor TU is connected to a pull-up control node Q, a first electrode of the pull-up transistor TU is connected to the output line OL, and a second electrode of the pull-up transistor TU is connected to the gate on voltage line VONL.

The pull-down transistor TD controls a connection of a gate off voltage line VOFFL and the output line OL according to a voltage of the pull-down control node QB. A control electrode of the pull-down transistor TD is connected to the pull-down control node QB, the first electrode of the pull-down transistor TD is connected to the gate off voltage line VOFFL, and the second electrode of the pull-down transistor TD is connected to the output line OL.

The node control circuit NC controls a voltage of the pull-up control node Q and a voltage of the pull-down control node QB. The node control circuit NC includes a plurality of signal input terminals. For example, the node control circuit NC may include a start terminal START into which a start signal is input, a clock terminal CLK into which a clock signal is input, and a reset terminal RESET into which a reset signal is input.

Further, the node control circuit NC may be connected to the gate on voltage line VONL and the gate off voltage line VOFFL. The start signal may be a gate start signal or a carry signal of a front end emission stage. The clock signal may be any one of a plurality of clock signals. The reset signal may be a carry signal of a rear end emission stage. The gate on voltage line may supply a gate on voltage, and the gate off voltage line may supply a gate off voltage. The gate on voltage may correspond to a voltage capable of turning on the transistors included in the emission stages, the display pixels, and the auxiliary pixels. The gate off voltage may correspond to a voltage capable of turning off the transistors in the emission stages, display pixels, and auxiliary pixels.

The node control circuit NC supplies the gate on voltage to the pull-up control node Q in response to the start signal input to the start terminal START, and supplies the gate off voltage to the pull-down control node QB. The pull-up transistor TU is turned on by the gate on voltage of the pull-up control node Q, and the pull-down transistor TD is turned off by the gate off voltage of the pull-down control node QB. Thus, the gate on voltage of the gate on voltage line VONL is output to the output line OL.

The node control circuit NC supplies the gate off voltage to the pull-up control node Q in response to the reset signal input to the reset terminal RESET, and supplies the gate on voltage to the pull-down control node QB. The pull-up transistor TU is turned off by the gate off voltage of the pull-up control node Q, and the pull-down transistor TD is turned on by the gate off voltage of the pull-down control node QB. Thus, the gate off voltage of the gate on voltage line VONL is output to the output line OL.

The pull-down control node QB of the second A emission control signal output unit EMA_OUT2 is connected to the first to $p^{th}$ control lines CCL1 to CCLp as illustrated in FIG. 6.

FIG. 6 illustrates an example of the case where the node control circuit NC includes only the start terminal START, the clock terminal CLK, and the reset terminal RESET. For convenience of the description, FIG. 8 exemplifies only the second A emission control signal output unit EMA_OUT2, and each of other A emission control signal output units and each of other B emission control signal output units may be substantially and identically implemented to the second A emission control signal output unit EMA_OUT2.

Figure 7:
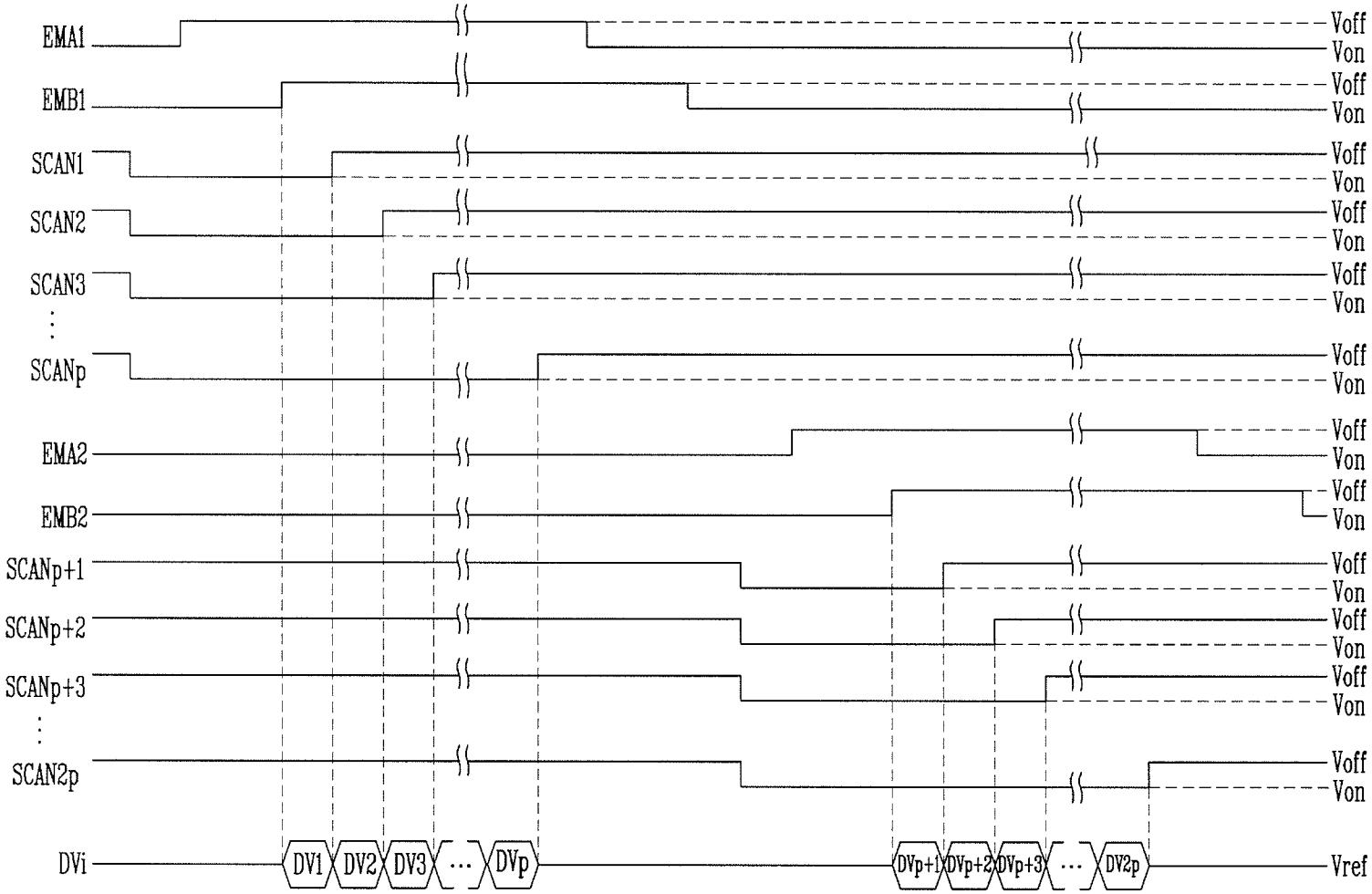
FIG. 7 illustrates examples of scan signals supplied to first to $2p^{th}$ scan lines, A emission control signals supplied to first to 2p $A^{th}$ emission control lines, B emission control signals supplied to first to 2p $B^{th}$ emission control lines, and data voltages supplied to an $i^{th}$ data line for FIG. 5.

FIG. 7 illustrates examples of the scan signals supplied to the first to $2p^{th}$ scan lines, the A emission control signals supplied to the first to $2p^{th}$ A emission control lines, the B emission control signals supplied to first to $2p^{th}$ B emission control lines, and the data voltages supplied to the $i^{th}$ data line of FIG. 5. For convenience of the description, FIG. 7 illustrates only the first to $2p^{th}$ scan signals SCAN1 to SCAN2*p* supplied to the first to $2p^{th}$ scan lines S1 to S2p, the first and second A emission control signals EMA1 and EMA2 supplied to the first to $2p^{th}$ A emission control lines EA1 to EA2p, the first and second B emission control signals EMB1 and EMB2 supplied to the first to $2p^{th}$ B emission control lines EB1 to EB2p, and the data voltages DVi supplied to the $i^{th}$ data line.

Referring to FIG. 7, pulses of the first to $2p^{th}$ scan signals SCAN1 to SCAN2p is generated by the gate on voltage Von. The scan signals are supplied in the unit of p. For example, as illustrated in FIG. 7, pulse widths of the first to $p^{th}$ scan signals SCAN1 to SCANp are sequentially increased, and pulse widths of the $p+1^{th}$ to $2p^{th}$ scan signals SCANp+1 to SCAN2p are sequentially increased.

Pulses of the A emission control signals EMA1 and EMA2 and the B emission control signals EMB1 and EMB2 are generated by the gate off voltage Voff. The pulse width of each of the A emission control signals EMA1 and EMA2 may be substantially or identically implemented to the pulse width of each of the B emission control signals EMB1 and EMB2. Further, the pulse width of each of the A emission control signals EMA1 and EMA2 and the pulse width of each of the B emission control signals EMB1 and EMB2 may be greater than the pulse width of each of the first to $2p^{th}$ scan signals SCAN1 to SCAN2p.

The $i^{th}$ data voltages DVi may be supplied in a cycle of one horizontal period (1H) from a time at which each of the B emission control signals EMB1 and EMB2 is changed from the gate on voltage Von to the gate off voltage Voff to be supplied. For example, the first to $p^{th}$ scan signals SCAN1 to SCANp are supplied as the gate on voltage Von for the period of the supply of the first data voltage DV1, and the first scan signal SCAN1 may be supplied as the gate off voltage Voff for the period of the supply of the second data voltage DV2, so that the first data voltage DV1 may be supplied to the display pixels DPs connected to the first scan signals SCAN1.

Further, the second to $p^{th}$ scan signals SCAN2 to SCANp may be supplied for the period of the supply of the second data voltage DV2, and the second scan signal SCAN2 may be supplied as the gate off voltage Voff for the period of the supply of a third data voltage DV3, so that the second data voltage DV2 may be supplied to the display pixels DPs connected to the second scna signals SCAN2.

The gate off voltage Voff may correspond to a voltage capable of turning off the transistors of the display pixels and the auxiliary pixels. The gate on voltage Von may correspond to a voltage capable of turning on the transistors of the display pixels and the auxiliary pixels.

Figure 8:
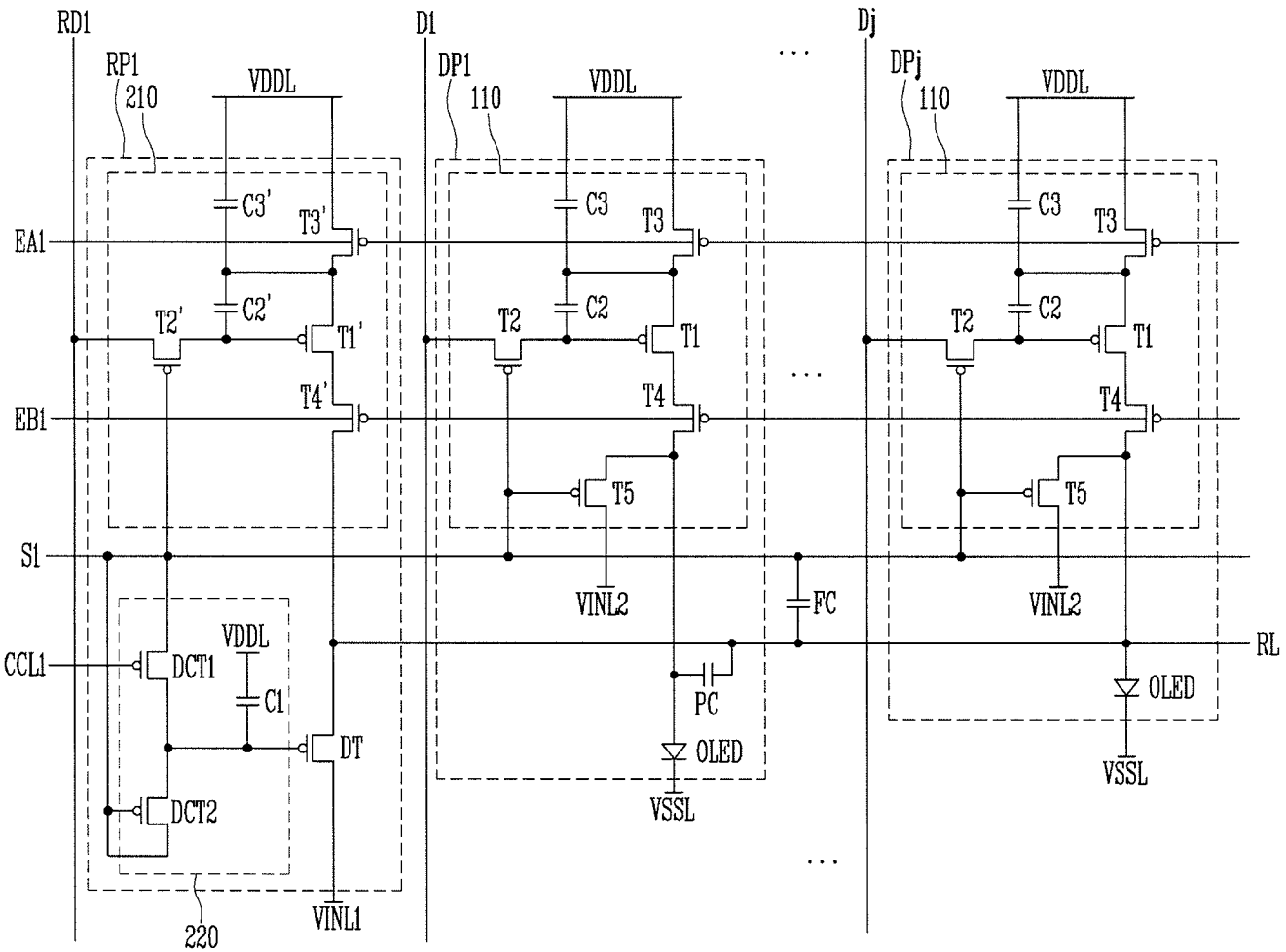
FIG. 8 illustrates another embodiment of display pixels.

FIG. 8 illustrates an embodiment of the display pixels and the auxiliary pixel. For convenience of the description, FIG. 8 illustrates only a $k^{th}$ scan line Sk (k is a positive integer satisfying $1 \leq k \leq n$), a first auxiliary data line RD1, first and $j^{th}$ data lines D1 and Dj (j is a positive integer satisfying $2 \leq j \leq m$), a $k^{th}$ A emission control line EAk, a $k^{th}$ B emission control line EBk, and a $k^{th}$ control line CCLk. Further, FIG. 8 illustrates only a first auxiliary pixel RP1 connected to a first auxiliary data line RD1, a first display pixel DP1 connected to a first data line D1, and a $j^{th}$ display pixel DPj connected to a $j^{th}$ data line Dj. Also, FIG. 8 illustrates that the first display pixel DP1 is a pixel in which a defect is not generated during the manufacturing process, and the $j^{th}$ display pixel DPj is a pixel in which a defect is generated during the manufacturing process and is repaired. Hereinafter, the first auxiliary pixel RP1, the first display pixel DP1, and the $j^{th}$ display pixel DPj will be described in detail with reference to FIG. 8.

Referring to FIG. 8, the first auxiliary pixel RP1 is connected to the $j^{th}$ display pixel DPj through the auxiliary line RL. The auxiliary line RL may be formed to be connected to the first auxiliary pixel RP1 and extended from the first auxiliary pixel RP1 to the display area DA to cross the display pixels DP1 and DPj. For example, the auxiliary line RL may be formed to cross the anode electrodes of the organic light emitting diodes OLEDs of the display pixels DP1 and DPj as illustrated in FIG. 8.

The auxiliary line RL may be connected to the organic light emitting diode OLED of the $j^{th}$ display pixel DPj. In this case, the display pixel driver 110 and the organic light emitting diode OLED of the $j^{th}$ display pixel DPj are disconnected.

Each of the display pixels DP1 and DPj includes the organic light emitting diode OLED and the display pixel driver 110.

The display pixel driver 110 of each of the display pixels DP1 and DPj is connected to the organic light emitting diode OLED, and supplies a driving current to the organic light emitting diode OLED. However, the display pixel driver 110 and the organic light emitting diode OLED of the $j^{th}$ display pixel DPj corresponding to the repaired pixel are disconnected.

The display pixel driver 110 may be connected to the scan line, the A emission control line, the B emission control line, the control line, and a plurality of power lines. For example, the display pixel driver 110 may be connected the $k^{th}$ scan line SK, the data line D1/Dj, the $k^{th}$ A emission control line EAk, the $k^{th}$ B emission control line EBk, and the second and third power voltage lines VDDL and VINL2. A second power voltage is supplied to a second power voltage line VDDL, and a third power voltage is supplied to the third power voltage line VINL2. The second power voltage line may be a high potential voltage, and the third power voltage may be an initialization power voltage for initializing the display pixel driver 110.

The display pixel driver 110 may include a plurality of transistors. For example, the display pixel driver 110 may include first to fifth transistors T1, T2, T3, T4, and T5, and second and third capacitors C2 and C2.

The first transistor T1 controls a driving current (drain-source current $I_{ds}$) according to a voltage of a control electrode thereof. The driving current $I_{ds}$ flowing through a channel of the first transistor T1 is in proportion to a square of a difference between a voltage between the control electrode and the first electrode of the first transistor T1 (a voltage between a gate and a source) and a threshold voltage as indicated in Equation 1.

$$I_{ds}=k'\cdot(V_{gs}-V_{th})^2 \quad (1)$$

In Equation 1, K' is a proportional coefficient determined by a structure and a physical property of a first transistor T1, $V_{gs}$ is a voltage between a control electrode and a first electrode of the first transistor T1, and $V_{th}$ is a threshold voltage of the first transistor T1.

A second transistor T2 is connected to the first electrode of the first transistor T1 and the data line D1/Dj. The second transistor T2 is turned on by a scan signal of the $K^{th}$ scan line Sk to connect the first electrode of the first transistor T1 and the data line D1/Dj. Accordingly, the data voltage of the data line D1/Dj is supplied to the first electrode of the first transistor T1. A control electrode of the second transistor T2 is connected to the $k^{th}$ scan line SK, a first electrode of the second transistor T2 is connected to the data line D1/Dj, and a second electrode of the second transistor T2 is connected to the first electrode of the first transistor T1. The control electrode may be a gate electrode, the first electrode may be a source electrode or a drain electrode, and the second electrode may be an electrode different from the first electrode. For example, when the first electrode is a source electrode, the second electrode is a drain electrode.

A third transistor T3 is connected to the second power voltage line VDDL and the first electrode of the first transistor T1. The third transistor T3 is turned on by an emission control signal of the $k^{th}$ A emission control line EAk to connect the second power voltage line VDDL and the first electrode of the first transistor T1. Accordingly, a second power voltage is supplied to the first electrode of the first transistor T1. A control electrode of the third transistor T3 is connected to the $k^{th}$ emission control line Ek, a first electrode of the third transistor T3 is connected to the second power voltage line VDDL, and a second electrode of the third transistor T3 is connected to the first electrode of the first transistor T1.

A fourth transistor T4 is connected to the second electrode of the first transistor T1 and the organic light emitting diode OLED. The fourth transistor T4 is turned on by the emission control signal of the Kth B emission control line EBk to connect the second electrode of the first transistor T1 and the organic light emitting diode OLED. A control electrode of the fourth transistor T4 is connected to the kth B emission control line EBk, a first electrode of the fourth transistor T4 is connected to the second electrode of the first transistor T1, and a second electrode of the fourth transistor T4 is connected to the organic light emitting diode OLED.

When the third and fourth transistors T3 and T4 are turned on, the driving current $I_{ds}$ of the display pixel driver 110 is supplied to the organic light emitting diode OLED. Accordingly, the organic light emitting diode OLED of the first display pixel DP1 emits light.

The fifth transistor T5 is connected to the control electrode of the first transistor T1 and a third power voltage line VINL2 to which a third power voltage is supplied. The fifth transistor T5 is turned on by the scan signal of the Kth scan line Sk to connect the control electrode of the first transistor T1 and the third power voltage line VINL2. Accordingly, the control electrode of the first transistor T1 may be initialized with the third power voltage. A control electrode of the fifth transistor T5 is connected to the kth scan line Sk, a first electrode of the fifth transistor T5 is connected to the control electrode of the first transistor T1, and a second electrode of the fifth transistor T5 is connected to the third power voltage line VINL2.

The organic light emitting diode OLED emits according to the driving current $I_{ds}$ of the display pixel driver 110. The amount of emission of the organic light emitting diode OLED may be in proportion to the driving current $I_{ds}$. An anode electrode of the organic light emitting diode OLED is connected to the second electrode of the fourth transistor T4, and a cathode electrode of the organic light emitting diode OLED is connected to the fourth power voltage line VSSL. A fourth power voltage is supplied to the fourth power voltage line VSSL.

The second capacitor C2 is connected to the control electrode and the first electrode of the first transistor T1. For example, one electrode of the second capacitor C2 is connected to the control electrode of the first transistor T1, and the other electrode of the second capacitor C2 is connected to the first electrode of the first transistor T1.

A third capacitor C3 is connected to the first electrode of the first transistor T1 and the second power voltage line VDDL. For example, one electrode of the third capacitor C3 is connected to the control electrode of the first transistor T1, and the other electrode of the third capacitor C3 is connected to the first electrode of the first transistor T1.

In FIG. 8, the description has been given based on the case where the first to fifth transistors T1, T2, T3, T4, and T5 of the display pixel driver 110 are implemented as PMOS transistors. In another embodiment, the first to fifth transistors T1, T2, T3, T4, and T5 of the display pixel driver 110 may be implemented as NMOS transistors.

Each of the auxiliary pixels RP includes an auxiliary pixel driver 210, a discharge transistor DT, and a discharge transistor controller 220. Each of the auxiliary pixels RP1s does not include the organic light emitting diode OLED. The auxiliary pixel driver 210 is connected to the auxiliary line RL. Accordingly, the driving current of the auxiliary pixel driver 210 is supplied to the organic light emitting diode OLED of the $j^{th}$ display pixel DPj through the auxiliary line RL.

The display pixel driver 210 may be connected to the scan line, the auxiliary data line, the A emission control line, the B emission control line, and the plurality of power lines. For example, the display pixel driver 210 may be connected the $k^{th}$ scan line SK, the first auxiliary data line RD1, the $k^{th}$ A emission control line EAk, the $k^{th}$ B emission control line EBk, and the second and third power voltage lines VDDL and VINL2.

The auxiliary pixel driver 210 may include a plurality of transistors, e.g., first to fourth transistors T1', T2', T3', and T4'. The first and third transistors T1' and T3' and second and third capacitors C2' and C3' of the auxiliary pixel driver 210 may be substantially or identically formed to the first and third transistors T1 and T3 and the second and third capacitors C2 and C3 of the display pixel driver 110.

The second transistor T2' is connected to a first electrode of the first transistor T1' and the first auxiliary data line RD1. The second transistor T2' is turned on by the scan signal of the $K^{th}$ scan line Sk to connect to the first electrode of the first transistor T1' and the first auxiliary data line RD1. Accordingly, the auxiliary data voltage of the first auxiliary data line RD1 is supplied to the first electrode of the first transistor T1'. A control electrode of the second T2' is connected to the $k^{th}$ scan line Sk, a first electrode of the second transistor T2' is connected to the first auxiliary data line RD1, and a second electrode of the second transistor T2' is connected to the first electrode of the first transistor T1'.

The fourth transistor T4' is connected to a second electrode of the first transistor T1'. The fourth transistor T4' is turned on by the emission control signal of the $K^{th}$ B emission control line EBk to connect the second electrode of the first transistor T1' and the auxiliary line RL. A control electrode of the fourth transistor T4' is connected to the $k^{th}$ B emission control line EBk, a first electrode of the fourth transistor T4' is connected to the second electrode of the first transistor T1' and a second electrode of the fourth transistor T4' is connected to the auxiliary line RL. When the third and fourth transistors T3' and T4' are turned on, a driving current $I_{ds}'$ is supplied to the organic light emitting diode OLED of the $j^{th}$ display pixel DPj through the auxiliary line RL, so that the organic light emitting diode OLED of the $j^{th}$ display pixel DPj emits light.

The discharge transistor DT is connected to the auxiliary line RL and the first power voltage line VINL1. The first power voltage is supplied to the first power voltage line VINL1. The first power voltage may be an initialization power voltage for initializing the auxiliary line RL.

For example, the discharge transistor DT is turned on by the voltage supplied to the control electrode of the discharge transistor DT to connect the auxiliary line RL and the first power voltage line VINL1. Accordingly, the voltage of the auxiliary line RL is discharged with the first power voltage. For example, the discharge transistor DT serves to discharge the auxiliary line RL. The control electrode of the discharge transistor DT may be connected to the discharge transistor controller 220, a first electrode of the discharge transistor DT may be connected to the auxiliary line RL, and a second electrode of the discharge transistor DT may be connected to the first power voltage line VINL1.

The discharge transistor controller 220 controls turn-on and turn-off of the discharge transistor DT. The discharge transistor controller 220 may include a plurality of transistors and the first capacitor C1. For example, the discharge transistor controller 220 may include, for example, first and second discharge control transistors DCT1 and DCT2 and the first capacitor C1 as illustrated in FIG. 8.

Each of the first and second discharge control transistors DCT1 and DCT2 is connected to the control electrode of the discharge transistor DT. In this case, a control electrode of the first discharge control transistor DCT1 and a control electrode of the second discharge control transistor DCT2 are connected to different lines.

For example, the first discharge control transistor DCT1 may be connected to the control electrode of the discharge transistor DT and the $k^{th}$ scan line Sk. The control electrode of the first discharge control transistor DCT1 may be connected to the $k^{th}$ control line CCLk, a first electrode of the first discharge control transistor DCT1 may be connected to the $k^{th}$ scan line Sk, and a second electrode of the first discharge control transistor DCT1 may be connected to the control electrode of the discharge transistor DT.

The second discharge control transistor DCT2 may be connected to the control electrode of the discharge transistor DT and the $k^{th}$ scan line Sk. The control electrode and the second electrode of second discharge control transistor DCT2 are connected to the $k^{th}$ scan line, and the first electrode of the second discharge control transistor DCT2 is connected to the control electrode of the discharge transistor DT. For example, the second discharge control transistor DCT2 is driven as a diode.

The first capacitor C1 is connected to the control electrode of the discharge transistor DT and the second power voltage line VDDL to maintain a voltage of the control electrode of the discharge transistor DT. One electrode of the first capacitor C1 is connected to the control electrode of the discharge transistor DT, and the other electrode of the first capacitor C1 is connected to the second power voltage line VDDL. The first capacitor C1 may be omitted in an another embodiment.

In FIG. 8, the description has been given based on the case where the first to fifth transistors T1', T2', T3', T4', and T5', the discharge transistor DT, and the first and second discharge control transistors DCT1 and DCT2 of the first auxiliary pixel RP1 are implemented as PMOS transistors. In another embodiment, the first to fifth transistors T1', T2', T3', T4', and T5', the discharge transistor DT, and the first and second discharge control transistors DCT1 and DCT2 of the first auxiliary pixel RP1 may be implemented as NMOS transistors.

As described above, the display pixel driver 110 of the remaining display pixels DP1 except for the $j^{th}$ display pixel corresponding to the repaired pixel is connected to the organic light emitting diode OLED, and supplies the driving current to the organic light emitting diode OLED. However, the display pixel driver 110 of the $j^{th}$ display pixel DPj is not connected with the organic light emitting diode OLED. For example, since the display pixel driver 110 of the $j^{th}$ display pixel DPj may not properly perform its function due to a defect, the display pixel driver 110 and the organic light emitting diode OLED are disconnected, and the anode electrode of the organic light emitting diode OLED of the $j^{th}$ display pixel DPj is connected to the auxiliary line RL, for example, through a laser short-circuit process.

Accordingly, the anode electrode of the organic light emitting diode OLED of the $j^{th}$ display pixel DPj may be connected to the auxiliary pixel driver 210 of the first auxiliary pixel RP1 through the auxiliary line RL. As a result, the organic light emitting diode OLED of the $j^{th}$ display pixel DPj receives the driving current from the auxiliary pixel driver 210 of the first auxiliary pixel RP1 to emit light. Thus, the $j^{th}$ display pixel DPj may be repaired.

FIG. 8 illustrates the first auxiliary pixel RP1 as an example of the auxiliary pixels. In one embodiment, each of the auxiliary pixels may be substantially or identically implemented to the first auxiliary pixel RP1. In other embodiments, the auxiliary pixels may have a different structure.

Further, FIG. illustrates only the first display pixel DP1 as one of the display pixels in which a defect is not generated. In one embodiment, each of the display pixels, in which a defect is not generated, may be substantially or identically implemented as the first display pixel DP1. Further, FIG. 8 exemplifies only the $j^{th}$ display pixel DPj as an example of the repaired pixels. Each of the repaired pixels may be substantially or identically implemented to the $j^{th}$ display pixel DPj.

The auxiliary line RL overlaps the anode electrodes of the organic light emitting diodes OLEDs of the display pixels, so that parasitic capacitance PC may be formed between the auxiliary line RL and the anode electrodes of the organic light emitting diodes OLEDs of the display pixels as illustrated in FIG. 8. Further, the auxiliary line RL is formed in parallel to the $W^{th}$ scan line Sk while being adjacent to the $k^{th}$ scan line, so that fringe capacitance FC may be formed between the auxiliary line RL and the $W^{th}$ scan line as illustrated in FIG. 8. A voltage of the auxiliary line RL may be varied by the parasitic capacitance PC and the fringe capacitance FC. Thus, a problem may occur where the organic light emitting diode OLED of the $j^{th}$ display pixel DPj corresponding to the repaired pixel erroneously emits light.

In order to solve the problem, in accordance with one embodiment, the auxiliary line RL is discharged with the first power voltage using the discharge transistor DT. As a result, it is possible to prevent the voltage of the auxiliary line RL from varying by the parasitic capacitance PC and fringe capacitance FC. Accordingly, it is possible to prevent the organic light emitting diode OLED from erroneously emitting light. An example of this case is described with reference to FIG. 9.

Figure 9:
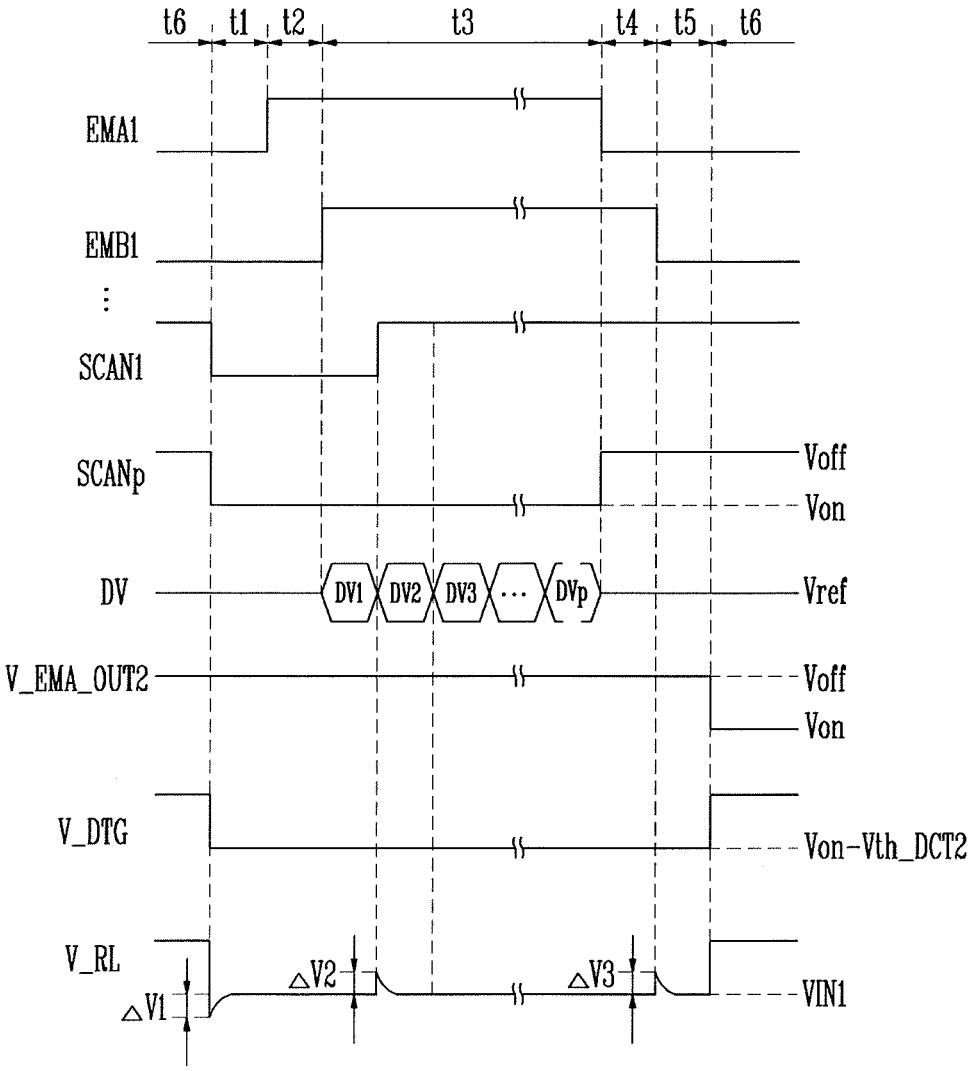
FIG. 9 illustrates another example of voltages for a display device.

FIG. 9 illustrates examples of signals supplied to the display pixels and the auxiliary pixels of FIG. 8, a voltage of the control electrode of the discharge transistor, and a voltage of the auxiliary line. In FIG. 9, the first scan signal SCAN1 is supplied to the first scan line S1, a $p^{th}$ scan signal SCANp is supplied to a $p^{th}$ scan line Sp, the first A emission control signal EMA1 is supplied to the first to $p^{th}$ A emission control lines EA1 to EAp, the first B emission control signal EMB1 is supplied to the first to $p^{th}$ B emission control lines EB1 to EBp, and a voltage V_EMA_OUT2 QB of the full-down control node QB of the second A emission control signal output unit EMA_OUT2 is supplied to the first to $p^{th}$ control lines CCL1 to CCLp. Also, a voltage V_DTG is supplied to the control electrode of the discharge transistor DT, and a voltage V_RL is supplied to the auxiliary line RL.

Referring to FIG. 9, the one frame period may be divided into a predetermined number of periods. e.g. first to sixth periods t1 to t6. The first and $p^{th}$ scan signals SCAN1 and SCANp are generated as the gate on voltage Von for the first to third periods t1 to t3. The first A emission control signal EMA1 is generated as the gate off voltage Voff for the second and third periods t2 and t3. The first B emission control signal EMB1 is generated as the gate off voltage Voff for the third and fourth periods t3 and t4. The voltage V_EMA_OUT2_QB of the full-down control node QB of the second A emission control signal output unit EMA_OUT2 is generated as the gate on voltage Von only for the sixth period t6. The gate off voltage Voff corresponds to a voltage capable of turning off the transistors of the display pixels and the auxiliary pixels. The gate on voltage Von corresponds to a voltage capable of turning on the transistors of the display pixels and the auxiliary pixels.

Hereinafter, a driving method of the first auxiliary pixel RP1 and the $j^{th}$ display pixel DPj, and a driving method of the first display pixel DP1 will be described in detail with reference to FIGS. 8 and 9. In this case, the description will be given based on that the scan signal supplied to the $k^{th}$ scan line Sk of FIG. 8 is the first scan signal SCAN1 or the $p^{th}$ scan signal SCANp of FIG. 9, the A emission control signal supplied to the $k^{th}$ A emission control line EAk of FIG. 8 is the first A emission control signal EMA1 of FIG. 9, the B emission control signal supplied to the $k^{th}$ B emission control line EBk of FIG. 8 is the first B emission control signal EMB1 of FIG. 9, and a voltage supplied to the $k^{th}$ control line CCLK of FIG. 8 is a voltage V_EMA_OUT2_QB of the full-down control node QB of the second A emission control signal output unit EMA_OUT2.

First, the first period t1 is a period for which an on-bias is applied to the first transistor T1. For the first period t1, the first scan signal SCAN1 of the gate on voltage Von is supplied to the $p^{th}$ scan line Sp. The first A emission control signal EMA1 of the gate on voltage Von is supplied to the first A emission control line EAk. The first B emission control signal EMB1 of the gate on voltage Von is supplied to the first B emission control line EBk. Accordingly, the second to fifth transistors T2, T3, T4, and T5 are turned on for the first period t1.

Because the second transistor T2 is turned on, the control electrode of the first transistor T1 is initialized with the initialized voltage Vref of the first data line D1. Because the third to fifth transistors T3, T4, and T5 are turned on, a current path is formed through which a current flows from the second power voltage line VDDL to the third power voltage line VINL2 via the third transistor T3, the first transistor T1, the fourth transistor T4, and the fifth transistor T5. The first transistor T1 may be implemented as a PMOS transistor, so that when a voltage difference $V_{gs}$ between the control electrode and the first electrode of the first transistor T1 is smaller than a threshold voltage $V_{th}$ of the first transistor T1, the first transistor T1 is turned on. The third power voltage VIN2 is set to be sufficiently lower than the second power voltage VDD, so that the voltage difference ($V_{gs}$=VIN2−VDD) between the control electrode and the first electrode of the first transistor T1 is smaller than the threshold voltage $V_{th}$ of the first transistor T1 for the first period t1. Thus, current flows through the current path.

As a result, the control electrode of the first transistor T1 is discharged with the third power voltage and the on-bias may be applied to the first transistor T1 for the first period t1. Thus, it is possible to apply the on-bias to the first transistor T1 before the data voltage is supplied to the control electrode of the first transistor T1, thereby solving a problem in that an image quality deteriorates due to a hysteresis characteristic of the first transistor T1.

Second, the second period t2 is a period for which the threshold voltage of the first transistor is sampled. For the second period t2, the first scan signal SCAN1 of the gate on voltage Von is supplied to the first scan line S1, the $p^{th}$ scan signal SCANp of the gate on voltage Von is supplied to the $p^{th}$ scan line Sp, the first A emission control signal EMA1 of the gate off voltage Voff is supplied to the first A emission control line EAk, and the first B emission control signal EMB1 of the gate on voltage Von is supplied to the first B emission control line EBk. Accordingly, the second, fourth, and fifth transistors T2, T4, and T5 are turned on for the second period t2.

Because the second transistor T2 is turned on, the control electrode of the first transistor T1 is initialized with the initialized voltage Vref of the first data line D1. Because the third transistor T3 is turned off, the first electrode of the first transistor T1 is floated. Because a voltage difference ($V_{gs}$=VIN2−Vdata) between the control electrode and the first electrode of the first transistor T1 is smaller than the threshold voltage $V_{th}$ for the second period t2, a current flows through the first transistor T1 until the voltage difference $V_{gs}$ between the control electrode and the first electrode reaches the threshold voltage $V_{th}$ of the first transistor T1. Accordingly, the voltage of the first electrode of the first transistor T1 is dropped to "VIN2−$V_{th}$," for the second period t2.

Third, the third period t3 is a period for which the data voltage is supplied to the control electrode of the first transistor T1. For the third period t3, the first scan signal SCAN1 of the gate on voltage Von is supplied to the first scan line S1, the $p^{th}$ scan signal SCANp of the gate on voltage Von is supplied to the $p^{th}$ scan line Sp, the first A emission control signal EMA1 of the gate off voltage Voff is supplied to the first A emission control line EAk, and the first B emission control signal EMB1 of the gate off voltage Voff is supplied to the first B emission control line EBk. Accordingly, the second transistor T2 is turned on for the third period t3.

Because the second transistor T2 is turned on, the data voltage Vdata is supplied to the control electrode of the first transistor T1. In this case, a variation of the voltage of the control electrode of the first transistor T1 is reflected to the first electrode of the first transistor T1 by the second capacitor C2. Accordingly, the voltage of the first electrode of the first transistor T1 is changed to "VIN2−$V_{th}$+α".

Fourth, the fourth period t4 is a period for which the sampling of the data voltage and the threshold voltage is completed. For the fourth period t4, the first scan signal SCAN1 of the gate off voltage Voff is supplied to the first scan line S1, the $p^{th}$ scan signal SCANp of the gate off voltage Voff is supplied to the $p^{th}$ scan line Sp, the first A emission control signal EMA1 of the gate on voltage Von is supplied to the first A emission control line EAk, and the first B emission control signal EMB1 of the gate off voltage Voff is supplied to the first B emission control line EBk. Accordingly, the third transistor T3 is turned on for the fourth period t4.

Because the third transistor T3 is turned on, the first electrode of the first transistor T1 is connected to the second power voltage line VDDL. Accordingly, the second power voltage is supplied to the first electrode of the first transistor T1 for the fourth period t4. In this case, a variation of the voltage of the first electrode of the first transistor T1 is reflected to the control electrode of the first transistor T1 by the second capacitor C2. However, the voltage difference $V_{gs}$ between the control electrode and the first electrode of the first transistor T1 is maintained at "Vdata−(VIN2−$V_{th}$+α)".

Fifth, the fifth period t5 is a period for which the organic light emitting diode OLED emits light. For the fifth period t5, the first scan signal SCAN1 of the gate off voltage Voff is supplied to the first scan line S1, the $p^{th}$ scan signal SCANp of the gate off voltage Voff is supplied to the $p^{th}$ scan line Sp, the first A emission control signal EMA1 of the gate on voltage Von is supplied to the first A emission control line EAk, and the first B emission control signal EMB1 of the gate on voltage Von is supplied to the first B emission control line EBk. Accordingly, the third and fourth transistors T3 and T4 are turned on for the fifth period t5.

Because the third and fourth transistors T3 and T4 are turned on, the driving current $I_{ds}$ flows through the first transistor T1 according to the voltage difference $V_{gs}$ between the control electrode and the first electrode of the first transistor T1 for the fifth period t5. The voltage difference $V_{gs}$ between the control electrode and the first electrode of the first transistor T1 is maintained at "Vdata−(VIN2−$V_{th}$+α)" for the fifth period t5. In this case, the driving current $I_{ds}$ flowing through the first transistor T1 may be defined as Equation 2.

$$I_{ds}=k'\cdot(V_{gs}-V_{th})^2=k'\cdot[\{V_{data}-(VIN2-Vth+\alpha)\}-Vth]^2 \quad (2)$$

In Equation 2, k' is a proportional coefficient determined by a structure and a physical property of the first transistor T1, $V_{gs}$ is a voltage between the control electrode and the first electrode of the first transistor T1, $V_{th}$ is the threshold voltage of the first transistor T1, VIN2 is the third power voltage, and Vdata is the data voltage. The voltage difference between the control electrode and the first electrode of the first transistor T1 is "Vdata−(VIN2−$V_{th}$+α)". When Equation 2 is simplified, Equation 3 is deduced.

$$I_{ds}=k'\cdot(V_{data}-VIN2-\alpha)^2 \quad (3)$$

Finally, the driving current $I_{ds}$ is not dependent on the threshold voltage $V_{th}$ of the first transistor T1 as expressed by Equation 3. That is, the threshold voltage $V_{th}$ of the first transistor T1 is compensated. The driving current $I_{ds}$ of the display pixel driver 110 is supplied to the organic light emitting diode OLED. Accordingly, the organic light emitting diode OLED emits light.

Sixth, the sixth period t6 is a period for which the organic light emitting diode OLED emits light. For the sixth period t6, the first scan signal SCAN1 of the gate off voltage Voff is supplied to the first scan line S1, the $p^{th}$ scan signal SCANp of the gate off voltage Voff is supplied to the $p^{th}$ scan line Sp, the first A emission control signal EMA1 of the gate on voltage Von is supplied to the first A emission control line EAk, and the first B emission control signal EMB1 of the gate on voltage Von is supplied to the first B emission control line EBk. Accordingly, the third and fourth transistors T3 and T4 are turned on for the sixth period t6.

Because the third and fourth transistors T3 and T4 are turned on for the sixth period t6, the organic light emitting diode OLED emits light similar to the fifth period t5.

Hereinafter, a driving method of the first auxiliary pixel RP1 and the $j^{th}$ display pixel DPj will be described in detail. First, the first period t1 is a period for which an on-bias is applied to the first transistor T1'.

For the first period t1, the first scan signal SCAN1 of the gate on voltage Von is supplied to the first scan line S1, the $p^{th}$ scan signal SCANp of the gate on voltage Von is supplied to the $p^{th}$ scan line Sp, the first A emission control signal EMA1 of the gate on voltage Von is supplied to the first A emission control line EAk, the first B emission control signal EMB1 of the gate on voltage Von is supplied to the first B emission control line EBk, and the voltage V_EMA_OUT2_QB of the full-down control node QB of the second A emission control signal output unit EMA_OUT2 of the gate off voltage Voff is supplied to the first control line CCL1. Accordingly, the second to fourth transistors T2', T3', and T4' and the second discharge control transistor DCT2 are turned on for the first period t1.

Because the second discharge control transistor DCT2 is turned on, the control electrode of the discharge transistor DT is increased to have a voltage difference (Von−$V_{th}$_DCT2) between the gate on voltage Von and the threshold voltage $V_{th}$_DCT2 of the second discharge control transistor DCT2. Accordingly, the discharge transistor DT is turned on.

Because the second transistor T2' is turned on, the control electrode of the first transistor T1' is initialized with the initialized voltage Vref of the first data line D1. Because the third and fourth fifth transistors T3' and T4', and the discharge transistor DT are turned on, a current path, through which a current flows from the second power voltage line VDDL to the first power voltage line VINL1 via the third transistor T3', the first transistor T1', the fourth transistor T4', and the discharge transistor DT, is formed.

For example, the first transistor T1' is implemented as a PMOS transistor, so that when a voltage difference $V_{gs}$ between the control electrode and the first electrode of the first transistor T1' is smaller than a threshold voltage $V_{th}$ of the first transistor T1' ($V_{gs}<V_{th}$), the first transistor T1' is turned on. The third power voltage VIN2 is set to be sufficiently lower than the second power voltage VDD, so that the voltage difference ($V_{gs}$=VIN2−VDD) between the control electrode and the first electrode of the first transistor T1 is smaller than the threshold voltage $V_{th}$ of the first transistor T1' for the first period t1, and thus the current flows through the current path.

As a result, the control electrode of the first transistor T1' is discharged with the third power voltage and the on-bias may be applied to the first transistor T1' for the first period t1. Thus, it is possible to apply the on-bias to the first transistor T1' before the data voltage is supplied to the control electrode of the first transistor T1', thereby solving a problem in that an image quality deteriorates due to a hysteresis characteristic of the first transistor T1'.

Second, the second period t2 is a period for which the threshold voltage of the first transistor' is sampled. For the second period t2, the first scan signal SCAN1 of the gate on voltage Von is supplied to the first scan line S1, the $p^{th}$ scan signal SCANp of the gate on voltage Von is supplied to the $p^{th}$ scan line Sp, the first A emission control signal EMA1 of the gate off voltage Voff is supplied to the first A emission control line EAk, the first B emission control signal EMB1 of the gate on voltage Von is supplied to the first B emission control line EBk, and the voltage V_EMA_OUT2_QB of the full-down control node QB of the second A emission control signal output unit EMA_OUT2 of the gate off voltage Voff is supplied to the first control line CCL1. Accordingly, the second and fourth transistors T2' and T4' and the second discharge control transistor DCT2 are turned on for the second period t2.

Because the second discharge control transistor DCT2 is turned on, the control electrode of the discharge transistor DT maintains a voltage difference (Von−$V_{th}$_DCT2) between the gate on voltage Von and the threshold voltage $V_{th}$_DCT2 of the second discharge control transistor DCT2. Accordingly, the discharge transistor DT is turned on. Because the discharge transistor DT is turned on, the auxiliary line RL is connected to the first power voltage line VIN1 to be discharged with the first power voltage.

Because the second transistor T2' is turned on, the control electrode of the first transistor T1' is initialized with the initialized voltage Vref of the first data line D1. Because the third transistor T3' is turned off, the first electrode of the first transistor T1' is floated. Since a voltage difference ($V_{gs}$=VIN2−Vdata) between the control electrode and the first electrode of the first transistor T1' is smaller than the threshold voltage $V_{th}$ for the second period t2, a current flows through the first transistor T1' until the voltage difference $V_{gs}$ between the control electrode and the first electrode reaches the threshold voltage $V_{th}$ of the first transistor T1'. Accordingly, the voltage of the first electrode of the first transistor T1' is dropped to "VIN2−$V_{th}$" for the second period t2.

Third, the third period t3 is a period for which the data voltage is supplied to the control electrode of the first transistor T1'. For the third period t3, the first scan signal SCAN1 of the gate on voltage Von is supplied to the first scan line S1, the $p^{th}$ scan signal SCANp of the gate on voltage Von is supplied to the $p^{th}$ scan line Sp, the first A emission control signal EMA1 of the gate off voltage Voff is supplied to the first A emission control line EAk, the first B emission control signal EMB1 of the gate off voltage Voff is supplied to the first B emission control line EBk, and the voltage V_EMA_OUT2_QB of the full-down control node QB of the second A emission control signal output unit EMA_OUT2 of the gate off voltage Voff is supplied to the first control line CCL1. Accordingly, the second transistor T2 and the second discharge control transistor CDT2 are turned on for the third period t3.

Because the second discharge control transistor DCT2 is turned on, the control electrode of the discharge transistor DT maintains a voltage difference (Von−$V_{th}$_DCT2) between the gate on voltage Von and the threshold voltage $V_{th}$_DCT2 of the second discharge control transistor DCT2. Accordingly, the discharge transistor DT is turned on. Because the discharge transistor DT is turned on, the auxiliary line RL is connected to the first power voltage line VIN1 to be discharged with the first power voltage.

Because the second transistor T2' is turned on, the data voltage Vdata is supplied to the control electrode of the first transistor T1'. In this case, a variation of the voltage of the control electrode of the first transistor T1' is reflected to the first electrode of the first transistor T1' by the second capacitor C2'. Accordingly, the voltage of the first electrode of the first transistor T1' is changed to "$VIN2-V_{th}+\alpha$".

Because the first scan line S1 and the auxiliary line RL are formed to be parallel to each other, the fringe capacitance FC illustrated in FIG. 8 may be formed between the first scan line S1 and the auxiliary line RL. Accordingly, a voltage change of the first scan line S1 may be reflected to the auxiliary line RL by the fringe capacitance FC. Accordingly, when the first scan signal SCAN1 is increased to the gate off voltage Voff from the gate on voltage Von for the third period t3, the voltage change of the first scan line S1 is reflected to the auxiliary line RL by the fringe capacitance FC, so that the voltage of the auxiliary line RL may be increased by ΔV1. However, the auxiliary line RL is connected to the first power voltage line VINL1 for the third period t3, so that even though the voltage change of the first scan line S1 is reflected by the fringe capacitance FC, the auxiliary line RL is discharged with the first power voltage VIN1.

Fourth, the fourth period t4 is a period for which the sampling of the data voltage and the threshold voltage is completed. For the fourth period t4, the first scan signal SCAN1 of the gate off voltage Voff is supplied to the first scan line S1, the $p^{th}$ scan signal SCANp of the gate off voltage Voff is supplied to the $p^{th}$ scan line Sp, the first A emission control signal EMA1 of the gate on voltage Von is supplied to the first A emission control line EAk, the first B emission control signal EMB1 of the gate off voltage Voff is supplied to the first B emission control line EBk, and the voltage V_EMA_OUT2_QB of the full-down control node QB of the second A emission control signal output unit EMA_OUT2 of the gate off voltage Voff is supplied to the first control line CCL1. Accordingly, the third transistor T3 is turned on for the fourth period t4.

Even though the second discharge control transistor DCT2 is turned on for the fourth period t4, the control electrode of the discharge transistor DT maintains a voltage difference ($Von-V_{th}$_DCT2) between the gate on voltage Von and the threshold voltage $V_{th}$_DCT2 of the second discharge control transistor DCT2 by the first capacitor. Accordingly, the discharge transistor DT is turned on.

Because the third transistor T3 is turned on, the first electrode of the first transistor T1 is connected to the second power voltage line VDDL. Accordingly, the second power voltage is supplied to the first electrode of the first transistor T1 for the fourth period t4. In this case, a variation of the voltage of the first electrode of the first transistor T1 is reflected to the control electrode of the first transistor T1 by the first capacitor C1. However, the voltage difference $V_{gs}$ between the control electrode and the first electrode of the first transistor T1 is maintained at "$Vdata-(VIN2-V_{th}+\alpha)$".

Fifth, the fifth period t5 is a period for which the auxiliary line RL is discharged with the first power voltage. For the fifth period t5, the first scan signal SCAN1 of the gate off voltage Voff is supplied to the first scan line S1, the $p^{th}$ scan signal SCANp of the gate off voltage Voff is supplied to the $p^{th}$ scan line Sp, the first A emission control signal EMA1 of the gate on voltage Von is supplied to the first A emission control line EAk, the first B emission control signal EMB1 of the gate on voltage Von is supplied to the first B emission control line EBk, and the voltage V_EMA_OUT2_QB of the full-down control node QB of the second A emission control signal output unit EMA_OUT2 of the gate off voltage Voff is supplied to the first control line CCL1. Accordingly, the third and fourth transistors T3' and T4' are turned on for the fifth period t5.

Even though the second discharge control transistor DCT2 is turned off for the fifth t5, the control electrode of the discharge transistor DT maintains a voltage difference ($Von-V_{th}$_DCT2) between the gate on voltage Von and the threshold voltage $V_{th}$_DCT2 of the second discharge control transistor DCT2 by the first capacitor C1. Accordingly, the discharge transistor DT is turned on.

Because the third and fourth transistors T3' and T4' are turned on, the driving current $I_{ds}$ flows through the first transistor T1 according to the voltage difference $V_{gs}$ between the control electrode and the first electrode of the first transistor T1 for the fifth period t5. The voltage difference $V_{gs}$ between the control electrode and the first electrode of the first transistor T1' is maintained at "$Vdata-(VIN2-V_{th}+\alpha)$" for the fifth period t5. In this case, the driving current $I_{ds}$ flowing through the first transistor T1' may be defined as Equation 2. When Equation 2 is simplified, Equation 3 is deduced.

Finally, the driving current $I_{ds}$ is not dependent on the threshold voltage $V_{th}$ of the first transistor T1 as expressed by Equation 3. That is, the threshold voltage $V_{th}$ of the first transistor T1' is compensated.

However, the auxiliary line RL is connected to the first power voltage line VINL1 by the turn-on of the discharge transistor DT, the driving current $I_{ds}$ of the auxiliary pixel driver 210 is discharged to the first power voltage line VINL1 through the discharge transistor DT. Accordingly, the organic light emitting diode OLED of the $j^{th}$ display pixel DPj does not emit light for the fifth period t5.

The auxiliary line RL overlaps the anode electrodes of the organic light emitting diodes OLEDs of the display pixels DP1, so that parasitic capacitance PC may be formed between the auxiliary line RL and the anode electrodes of the organic light emitting diodes OLEDs of the display pixels DP1 as illustrated in FIG. 8. The voltage change of the anode electrodes of the organic light emitting diode OLED may be reflected to the auxiliary line RL by the parasitic capacitance PC. The driving currents are supplied to the anode electrodes of the organic light emitting diodes OLEDs of the pixels DP1 by the first B emission control signal EMB1 of the gate on voltage Von for the fifth period t5, so that the voltage change of the anode electrodes of the organic light emitting diodes OLEDs of the pixels DP1 is reflected to the auxiliary line RL by the parasitic capacitance PC, so that the voltage of the auxiliary line RL may be increased by ΔV2.

However, the auxiliary line RL is connected to the first power voltage line VINL1 for the fifth period t5, so that even though the voltage change of the anode electrodes of the organic light emitting diodes OLEDs of the display pixels DP1 is reflected by the fringe capacitance FC, the auxiliary line RL is discharged with the first power voltage VIN1.

Sixth, the sixth period t6 is a period for which the organic light emitting diode OLED emits light. For the sixth period t6, the first scan signal SCAN1 of the gate off voltage Voff is supplied to the first scan line S1, the $p^{th}$ scan signal SCANp of the gate off voltage Voff is supplied to the $p^{th}$ scan line Sp, the first A emission control signal EMA1 of the gate on voltage Von is supplied to the first A emission control line EAR, the first B emission control signal EMB1 of the gate on voltage Von is supplied to the first B emission control line EBk, and the voltage V_EMA_OUT2_QB of the full-down control node QB of the second A emission control signal output unit EMA_OUT2 of the gate on voltage Von is supplied to the first control line CCL1. Accordingly, the third and fourth transistors T3' and T4' and the first discharge control transistor DCT1 are turned on for the sixth period t6.

Because the first discharge control transistor DCT1 is turned on, the first scan signal SCAN1 of the gate off voltage Voff is supplied to the control electrode of the discharge transistor DT. Accordingly, the discharge transistor DT is turned off. Accordingly, the auxiliary line RL is not connected to the first power voltage line VINL1.

Further, because the third and fourth transistors T3' and T4' are turned on, the driving current Ids' of the auxiliary pixel driver 210 is supplied to the organic light emitting diode OLED of the $j^{th}$ display pixel DPj through the auxiliary line RL. Accordingly, the organic light emitting diode OLED of the $j^{th}$ display pixel DPj emits light.

As described above, in the present embodiment, it is possible to prevent the voltage of the auxiliary line RL from being varied by the parasitic capacitance PC and the fringe capacitance FC. As a result, it is possible to prevent the organic light emitting diode OLED of the $j^{th}$ display pixel DPj from erroneously emitting light by the parasitic capacitance PC and the fringe capacitance FC.

Figure 10:
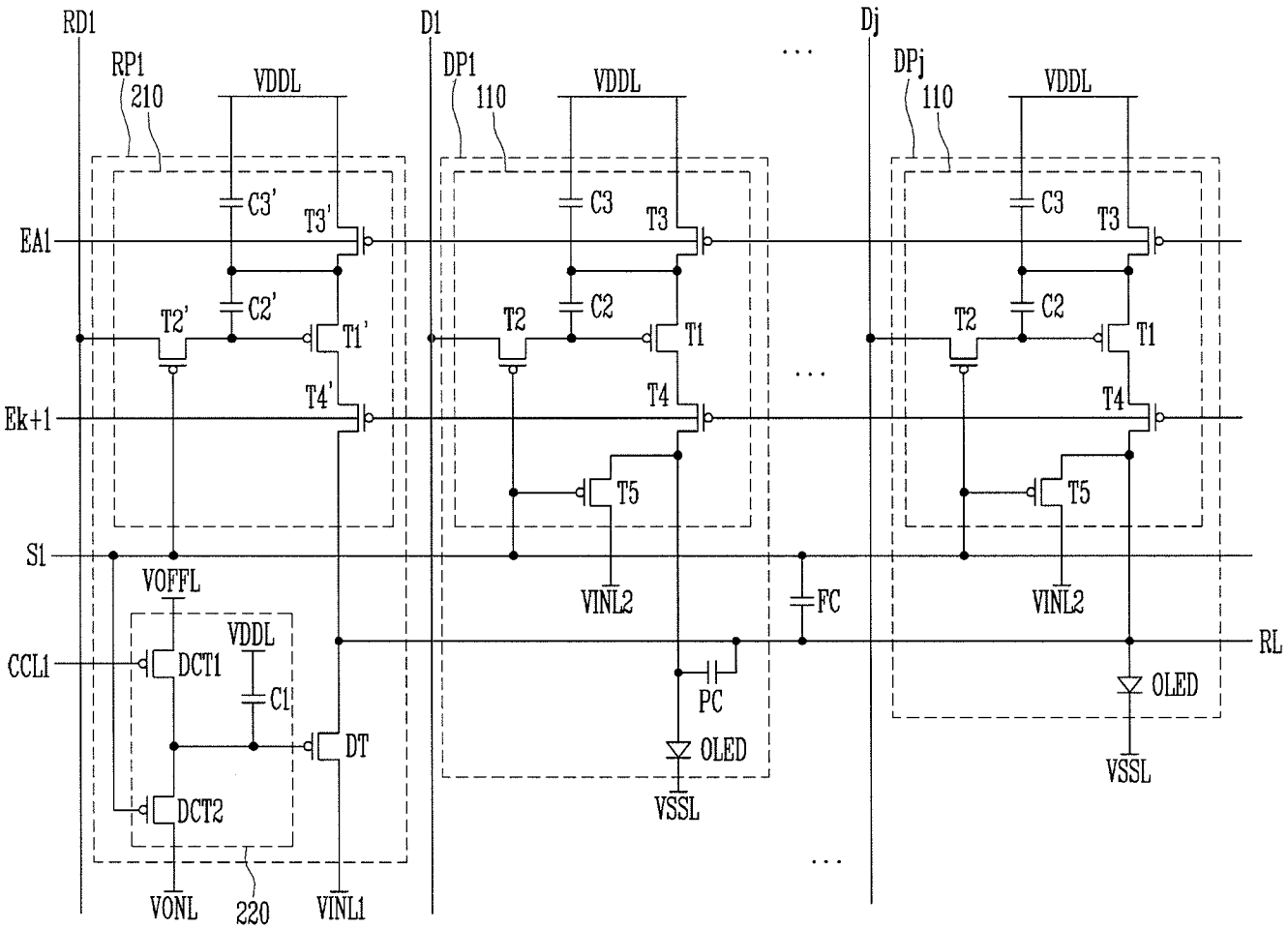
FIG. 10 illustrates another embodiment of display pixels.

FIG. 10 illustrates display pixels and the auxiliary pixel according to another exemplary embodiment. For convenience of the description, FIG. 10 illustrates only a $k^{th}$ scan line Sk, a first auxiliary data line RD1, a first and $j^{th}$ data lines D1 and Dj, a $k^{th}$ A emission control line EAk, a $K^{th}$ B emission control line EBk, and a $k^{th}$ control line CCLk. Further, FIG. 10 illustrates only the first auxiliary pixel RP1 connected to a first auxiliary data line RD1, a first display pixel DP1 connected to the first data line D1, and a $j^{th}$ display pixel DPj connected to the $j^{th}$ data line Dj. FIG. 10 illustrates that the first display pixel DP1 is a pixel in which a defect is not generated during the manufacturing process, and the $j^{th}$ display pixel DPj is a pixel in which a defect is generated during the manufacturing process and is repaired. Hereinafter, the first auxiliary pixel RP1, the first display pixel DP1, and the $j^{th}$ display pixel DPj will be described in detail with reference to FIG. 10.

Referring to FIG. 10, the first auxiliary pixel RP1 is connected to the $j^{th}$ display pixel DPj through the auxiliary line RL. The auxiliary line RL may be formed to be connected to the first auxiliary pixel RP1 and extended from the first auxiliary pixel RP1 to the display area DA to cross the display pixels DP1 and DPj. For example, the auxiliary line RL may be formed to cross the anode electrodes of the organic light emitting diodes OLEDs of the display pixels DP1 and DPj as illustrated in FIG. 10.

The auxiliary line RL may be connected to the organic light emitting diode OLED of the $j^{th}$ display pixel DPj. In this case, the display pixel driver 110 and the organic light emitting diode OLED of the $j^{th}$ display pixel DPj disconnected.

Each of the display pixels DP1 and DPj includes the organic light emitting diode OLED and the display pixel driver 110. The display pixels DP1 and DPj in FIG. 10 are substantially the same as the display pixels DP1 and DPj in FIG. 8.

The first auxiliary pixel RP1 includes an auxiliary pixel driver 210, a discharge transistor DT, and a discharge transistor controller 220. The first auxiliary pixel RP1 does not include an organic light emitting diode OLED.

The auxiliary pixel driver 210 and the discharge transistor DT of the first auxiliary pixel RP1 in FIG. 10 are substantially the same as the auxiliary pixel driver 210 and the discharge transistor DT of the first auxiliary pixel RP1 in FIG. 8.

The discharge transistor controller 220 controls turn-on and turn-off of the discharge transistor DT. The discharge transistor controller 220 may include a plurality of transistors and a first capacitor C1. For example, the discharge transistor controller 220 may include first and second discharge control transistors DCT1 and DCT2 and the first capacitor C1 as in FIG. 10.

Each of the first and second discharge control transistors DCT1 and DCT2 is connected to a control electrode of the discharge transistor DT. In this case, a control electrode of the first discharge control transistor DCT1 and a control electrode of the second discharge control transistor DCT2 are connected to different lines.

For example, the first discharge control transistor DCT1 may be connected to the control electrode of the discharge transistor DT and a gate off voltage line VOFFL. The control electrode of the first discharge control transistor DCT1 may be connected to the $k^{th}$ control line CCLk, a first electrode of the first discharge control transistor DCT1 may be connected to the gate off voltage line VOFFL, and a second electrode of the first discharge control transistor DCT1 may be connected to the control electrode of the discharge transistor DT.

The second discharge control transistor DCT2 may be connected to the control electrode of the discharge transistor DT and a gate on voltage line VONL. The control electrode of the second discharge control transistor DCT2 may be connected to the $k^{th}$ scan line Sk, a first electrode of the second discharge control transistor DCT2 may be connected to the control electrode of the discharge transistor DT, and a second electrode of the second discharge control transistor DCT2 may be connected to the gate off voltage line VONL.

The first capacitor C1 is connected to the control electrode of the discharge transistor DT and the second power voltage line VDDL to maintain a voltage of the control electrode of the discharge transistor DT. One electrode of the first capacitor C1 is connected to the control electrode of the discharge transistor DT, and the other electrode of the first capacitor C1 is connected to the second power voltage line VDDL. The first capacitor C1 may be omitted.

The signals supplied to the display pixels DP1 and DPj and the auxiliary pixel RP1 in FIG. 10 are substantially the same as those in FIG. 9. Further, driving methods of the display pixels DP1 and DPj and the auxiliary pixel RP1 illustrated in FIG. 10 are substantially the same as those described with reference to FIGS. 8 and 9.

The methods, processes, and/or operations described herein may be performed by code or instructions to be executed by a computer, processor, controller, or other signal processing device. The computer, processor, controller, or other signal processing device may be those described herein or one in addition to the elements described herein. Because the algorithms that form the basis of the methods (or operations of the computer, processor, controller, or other signal processing device) are described in detail, the code or instructions for implementing the operations of the method embodiments may transform the computer, processor, controller, or other signal processing device into a special-purpose processor for performing the methods described herein.

Also, another embodiment may include a computer-readable medium, e.g., a non-transitory computer-readable medium, for storing the code or instructions described above. The computer-readable medium may be a volatile or non-volatile memory or other storage device, which may be removably or fixedly coupled to the computer, processor, controller, or other signal processing device which is to execute the code or instructions for performing the method embodiments described herein.

By way of summation and review, during manufacturing of a display, a defect may occur for one or more of transistors of the pixels. As a result, manufacturing yield deteriorates. In an attempt to solve this problem, a method has been proposed to repair a defective pixel by forming auxiliary pixels in an organic light emitting display device and connecting the defective pixel to any one of the auxiliary pixels. However, in this method, parasitic capacitance may form between an auxiliary line and an anode electrode of an OLED in a pixels. Also, fringe capacitance may form between the auxiliary line and an adjacent scan line. In this case, a voltage of the auxiliary line may be changed by the parasitic capacitance and the fringe capacitance, and thus the OLED of the repaired pixel may erroneously emit light.

In accordance with one or more of the aforementioned embodiments, the auxiliary line is discharged with the first power voltage using a discharge transistor. As a result, it is possible to prevent a voltage of the auxiliary line from varying by parasitic capacitance between an auxiliary line and an anode electrode of an OLED in a display pixel and by fringe capacitance between the auxiliary line and a scan line adjacent to the auxiliary line. Accordingly, it is possible to prevent the OLEDs in the display from erroneously emitting light.

Example embodiments have been disclosed herein, and although specific terms are employed, they are used and are to be interpreted in a generic and descriptive sense only and not for purpose of limitation. In some instances, as would be apparent to one of skill in the art as of the filing of the present application, features, characteristics, and/or elements described in connection with a particular embodiment may be used singly or in combination with features, characteristics, and/or elements described in connection with other embodiments unless otherwise indicated. Accordingly, it will be understood by those of skill in the art that various changes in form and details may be made without departing from the spirit and scope of the present invention as set forth in the following claims.

What is claimed is:

1. An organic light emitting display device, comprising:
data lines;
auxiliary data lines;
scan lines and emission control lines crossing the data lines and the auxiliary data lines;
display pixels at corresponding intersections of the data lines, the scan lines, and the emission control lines;
auxiliary pixels at corresponding intersections of the auxiliary data lines, the scan lines, and the emission control lines; and
auxiliary lines connected to the auxiliary pixels, wherein:
in a first period, first to p-th row scan signals are supplied to first to p-th row scan lines, a first A emission control signal is supplied to first to p-th row A emission control lines, and a first B emission control signal is supplied to first to p-th row B emission control lines; and
in a second period, (p+1)-th to 2p-th row scan signals are supplied to (p+1)-th to 2p-th row scan lines, a second A emission control signal is supplied to (p+1)-th to 2p-th row A emission control lines, and a second B emission control signal is supplied to (p+1)-th to 2p-th row B emission control lines, and wherein $p \geq 2$.

2. The device as claimed in claim 1, wherein:
the first A emission control signal is simultaneously supplied to the first to p-th row A emission control lines, and
the first B emission control signal is simultaneously supplied to the first to p-th row B emission control lines.

3. The device as claimed in claim 1, wherein:
the first to p-th row scan signals are sequentially supplied to the first to p-th row scan lines, and
the first to p-th row scan signals are applied to have increasing pulse widths.

4. The device as claimed in claim 3, wherein a pulse width of a scan signal supplied to a $k+1^{th}$ row scan line is greater than a pulse width of a scan signal supplied to a $k^{th}$ row scan line.

5. The device as claimed in claim 1, wherein the auxiliary pixels include:
first to p-th row discharge transistors connected to first to p-th row auxiliary lines, and
a first power voltage line to receive a first power voltage, and wherein
the first to p-th row discharge transistors are controlled based on the second A emission control signal.

6. The device as claimed in claim 5, wherein each of the auxiliary pixels includes:
a plurality of transistors, and
a discharge transistor controller to control a corresponding discharge transistor.

7. The device as claimed in claim 6, wherein:
the discharge transistor controller includes first and second discharge control transistors connected to a control electrode of the corresponding discharge transistor, and
a control electrode of the first discharge control transistor and a control electrode of the second discharge control transistor are connected to different lines.

8. The device as claimed in claim 7, wherein:
the control electrode of the first discharge transistor is connected to a pull-down control node of an emission stage connected to a corresponding one of the emission control lines, and
the first discharge transistor includes:
a first electrode connected to a corresponding one of the scan lines, and
a second electrode connected to the control electrode of the corresponding discharge transistor, wherein the control electrode and a second electrode of the second discharge control transistor is connected to a corresponding one of the scan lines, and wherein
a first electrode of the second discharge control transistor is connected to the control electrode of the corresponding discharge transistor.

9. The device as claimed in claim 7, wherein:
the control electrode of the first discharge control transistor is connected to a pull-down control node of an emission stage connected to a corresponding one of the emission control lines, and
the first discharge control transistor includes a first electrode connected to a gate off voltage line to which a gate off voltage is supplied, and a second electrode connected to the control electrode of the corresponding discharge transistor,
the control electrode of the second discharge control transistor is connected to a corresponding one of the scan lines, and
the second discharge control transistor includes:
a first electrode connected to the control electrode of the corresponding discharge transistor and a second electrode connected to a gate on voltage line to receive a gate on voltage.

10. The device as claimed in claim 7, wherein the discharge transistor controller includes a first capacitor connected to the control electrode of the corresponding discharge transistor and a second power voltage line to receive a second power voltage.

11. The device as claimed in claim 5, wherein each of the auxiliary pixels includes an auxiliary pixel driver which includes a plurality of transistors, the auxiliary pixel driver to supply a driving current to a corresponding auxiliary line.

12. The device as claimed in claim 11, wherein the auxiliary pixel driver includes:

a first transistor to control the driving current according to a voltage of a control electrode;

a second transistor connected to a corresponding one of the auxiliary data lines and a control electrode of the first transistor;

a third transistor connected to a first electrode of the first transistor and a second power voltage line to which a second power voltage is supplied;

a fourth transistor connected to a second electrode of the first transistor and the corresponding auxiliary line;

a second capacitor connected to the control electrode and the first electrode of the first transistor; and a third capacitor connected to the first electrode of the first transistor and the second power voltage line.

13. The device as claimed in claim 12, wherein:

a control electrode of the second transistor is connected to a corresponding one of the scan lines, a control electrode of the third transistor is connected to a corresponding one of the A emission control lines, and a control electrode of the fourth transistor is connected to a corresponding one of the B emission control lines.

14. The device as claimed in claim 1, wherein the display pixel includes:

an organic light emitting diode; and a display pixel driver including a plurality of transistors, the display pixel driver to supply a driving current to the organic light emitting diode.

15. The device as claimed in claim 14, wherein the display pixel driver includes:

a first transistor to control the driving current according to a voltage of a control electrode;

a second transistor connected to a corresponding one of the data lines and a control electrode of the first transistor;

a third transistor connected to a first electrode of the first transistor and a second power voltage line to which a second power voltage is supplied;

a fourth transistor connected to a second electrode of the first transistor and an anode electrode of the organic light emitting diode;

a fifth transistor connected to the anode electrode of the organic light emitting diode and a third power voltage line to which a third power voltage is supplied;

a second capacitor connected to the control electrode and the first electrode of the first transistor; and a third capacitor connected to the first electrode of the first transistor and the second power voltage line.

16. The device as claimed in claim 15, wherein:

control electrodes of the second and fifth transistors are connected to a corresponding one of the scan lines, a control electrode of the third transistor is connected to a corresponding one of the A emission control lines, and a control electrode of the fourth transistor is connected to a corresponding one of the B emission control lines.

17. A driver, comprising:

a generator to generate auxiliary image data based on location information of a defective pixel to be repaired in a display; and a converter to adjust the auxiliary image data to at least partially compensate for at least one of a wire resistance of an auxiliary line coupled to an auxiliary pixel circuit or a parasitic capacitance of the auxiliary line, wherein the generator is to generate the adjusted auxiliary image data based on a repair control signal for the defective pixel, wherein the location information is a coordinate value of the defective pixel, wherein the converter is to add predetermined data to the auxiliary image data, the predetermined data corresponding to at least one of the wire resistance of the auxiliary line coupled to the auxiliary pixel circuit or the parasitic capacitance of the auxiliary line.

* * * * *